US010501855B2

(12) United States Patent
Cui et al.

(10) Patent No.: US 10,501,855 B2
(45) Date of Patent: Dec. 10, 2019

(54) BIFUNCTIONAL NON-NOBLE METAL OXIDE/CHALCOGENIDE NANOPARTICLE ELECTROCATALYSTS THROUGH LITHIUM-INDUCED CONVERSION FOR OVERALL WATER-SPLITTING

(71) Applicant: The Board of Trustees of the Leland Stanford Junior University, Palo Alto, CA (US)

(72) Inventors: Yi Cui, Stanford, CA (US); Haotian Wang, Palo Alto, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 249 days.

(21) Appl. No.: 15/088,573

(22) Filed: Apr. 1, 2016

(65) Prior Publication Data

US 2016/0289852 A1 Oct. 6, 2016

Related U.S. Application Data

(60) Provisional application No. 62/142,372, filed on Apr. 2, 2015.

(51) Int. Cl.
*C25B 11/04* (2006.01)

(52) U.S. Cl.
CPC ..... *C25B 11/0447* (2013.01); *C25B 11/0405* (2013.01); *C25B 11/0415* (2013.01)

(58) Field of Classification Search
CPC ..... C25B 11/0447; C25B 11/0405; C25B 11/0415
See application file for complete search history.

(56) References Cited

U.S. PATENT DOCUMENTS

2007/0087470 A1* 4/2007 Sunkara ..... C30B 25/00 438/99
2010/0210453 A1* 8/2010 Hu ..... B22F 7/002 502/184
2013/0040806 A1* 2/2013 Dismukes ..... B01J 35/004 502/159
2013/0092549 A1* 4/2013 Spurgeon ..... H01L 31/0586 205/340
2015/0188128 A1* 7/2015 Robinson ..... H01M 4/583 429/523

OTHER PUBLICATIONS

Wang, H. et al. (2015) "Bifunctional non-noble metal oxide nanoparticle electrocatalysts through lithium-induced conversion for overall water splitting," Nature Communications 6:7261.

* cited by examiner

*Primary Examiner* — Ciel P Thomas
(74) *Attorney, Agent, or Firm* — Foley & Lardner LLP; Cliff Z. Liu

(57) ABSTRACT

Described here is a method for improving the catalytic activity of an electrocatalyst, comprising subjecting the electrocatalyst to 1-10 galvanostatic lithiation/delithiation cycles, wherein the electrocatalyst comprises at least one transition metal oxide (TMO) or transition metal chalcogenide (TMC). Also described here is an electrocatalyst and a water-splitting device comprising the electrocatalyst.

14 Claims, 32 Drawing Sheets

BIFUNCTIONAL NON-NOBLE METAL OXIDE/CHALCOGENIDE NANOPARTICLE ELECTROCATALYSTS THROUGH LITHIUM-INDUCED CONVERSION FOR OVERALL WATER-SPLITTING

CROSS-REFERENCE TO RELATED APPLICATION

This application claims the benefit of U.S. Provisional Application No. 62/142,372, filed on Apr. 2, 2015, the disclosure of which is incorporated herein by reference in its entirety.

TECHNICAL FIELD

This disclosure relates to electrocatalysts with improved catalytic activity.

BACKGROUND

Electrochemical/photoelectrochemical water-splitting is widely considered to be an important step towards efficient renewable energy production, storage, and usage such as rechargeable metal-air batteries, fuel cells, and especially sustainable hydrogen production. Currently the state-of-the-art catalysts to split water are iridium (Ir) and platinum (Pt) for oxygen evolution reaction (OER) and hydrogen evolution reaction (HER) respectively, with about 1.5 V to reach 10 mA/cm$^2$ current (for integrated solar water-splitting). However, the price and scarcity of these noble metals present barriers for their scale-up deployment. A great deal of effort and progress have been made towards efficient OER and HER catalysts with earth-abundant materials, such as cobalt phosphate, perovskite oxides, and transition metal oxides/layer-double-hydroxides for OER, and transition metal dichalcogenides and nickel molybdenum alloy for HER. However, combining different OER and HER catalysts together in an integrated electrolyzer for practical use is difficult due to the mismatch of pH ranges in which these catalysts are stable and remain most active. In addition, producing different catalysts for OER and HER involves different equipment and processes, which could increase the cost.

Therefore, developing a bifunctional electrocatalyst with high activity towards both OER and HER in the same electrolyte remains challenging.

SUMMARY

Described here for some embodiments is an improved lithium conversion reaction method to significantly improve the water-splitting activities of transition metal oxides (TMOs) and transition metal chalcogenides (TMCs), as well as a bifunctional non-noble metal oxide or chalcogenide electrocatalyst for efficient overall water splitting to compete with Ir and Pt combination catalysts. One aspect of some embodiments of this disclosure relates to a method for improving the catalytic activity of an electrocatalyst, comprising subjecting the electrocatalyst to 1-10 galvanostatic lithiation/delithiation cycles, wherein the electrocatalyst comprises at least one TMO or TMC. Alternatively, the TMO or TMC electrocatalyst can be subjected to non-lithium-based galvanostatic cycling, such as sodium ion or potassium ion galvanostatic cycling.

In some embodiments, an electrocatalyst comprises TMO or TMC nanoparticles, wherein the TMO or TMC nanoparticles each further comprises a plurality of interconnected crystalline nanoparticles.

A further aspect of some embodiments of this disclosure relates to a water-splitting device, comprising the improved electrocatalyst described herein. The water-splitting device includes an anode, a cathode, and an electrolyte disposed between the anode and the cathode, and either or both of the anode and the cathode includes an electrocatalyst described herein. An additional aspect of some embodiments of this disclosure relates to a method for producing hydrogen comprising using the improved electrocatalyst described herein for catalyzing water-splitting reactions.

These and other features, together with the organization and manner of operation thereof, will become apparent from the following detailed description when taken in conjunction with the accompanying drawings.

DETAILED DESCRIPTION

Introduction

Figure 1:
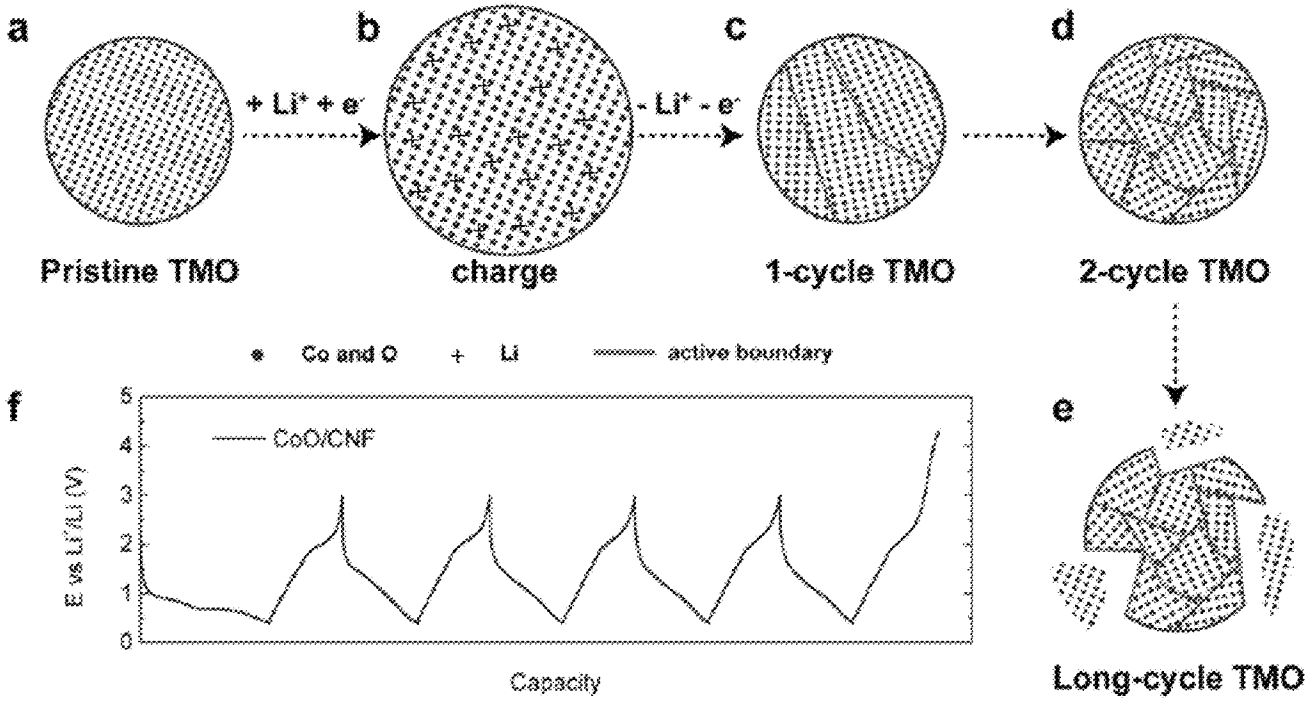
FIG. 1 shows a schematic of TMO morphology evolution under galvanostatic cycles. (A)-(E) TMO particles gradually change from a single crystalline particle to a plurality of ultra-small interconnected crystalline nanoparticles. Long-term battery cycling may result in the break-up of the mother particle. (F) The galvanostatic cycling profile of cobalt oxide/carbon nanofiber (CoO/CNF) galvanostatic cycling.

Developing earth-abundant, active, and stable electrocatalysts operated in the same electrolyte for water-splitting, including OER and HER, is important to many renewable energy conversion processes. Described is a significant improvement of catalytic activity when TMO (e.g., Fe, Co, Ni oxides and their mixed oxides) or TMC nanoparticles (e.g., about 20 nm) are electrochemically transformed into ultra-small diameter (e.g., about 2 nm to about 5 nm) nanoparticles through lithium-induced conversion reactions. Different from most traditional chemical synthesis, this method maintains excellent electrical interconnection among nanoparticles and creates large surface areas and many catalytically active sites. It is discovered that lithium-induced ultra-small $Ni_3FeO_x$ nanoparticles are excellent bifunctional catalysts exhibiting high activity and stability for both OER and HER in the same basic electrolyte. An overall water-splitting current of about 10 mA/cm$^2$ has been achieved in about 1 M KOH at about 1.51 V for over 200 hours without degradation, better than the combination of Ir and Pt as benchmark catalysts used in the same electrolyte.

To achieve high activities and stabilities of TMOs or TMCs in water-splitting electrolysis, several issues should be considered to guide the design of an ideal structure. Reducing the dimensions of TMOs can effectively increase electrochemical surface areas, expose active sites, and improve electrical conductivities, which can enhance both OER and HER activities. Successful examples such as TMO nanoparticles on carbon nanomaterials have shown improved catalytic activities by reducing the size of catalysts to tens of nanometers. However, those TMOs/carbon compounds do not strongly bind with substrates, which limits the long-term stability under violent gas evolution conditions. In addition, due to the hydrophobic nature of carbon, bubble-releasing becomes problematic during large current operations. Ultra-small (e.g., ≤about 5 nm) TMO nanoparticles by colloidal solution synthesis or pulsed-laser ablation can further increase the surface to volume ratio. However, those free standing nanoparticles can suffer from possible coverage of surfactants, and also can have poor electrical contact with each other, which can involve the use of carbon additives to improve conductivity.

Different from most traditional chemical synthesis, the method of embodiments of the present disclosure maintains excellent electrical interconnection among nanoparticles and creates large surface areas and many catalytically active sites. Those interconnected nanoparticles on conducting substrates without carbon additives also improve the bubble releasing process for large currents. The lithium conversion reaction method can significantly increase the surface areas of TMOs/TMCs, which thus improves their performances in applications such as water-splitting, oxygen reduction reaction, hydrogen reduction reaction, $CO_2$ reduction, methane oxidation, supercapacitors, and so forth.

TMOs and TMCs are chosen as candidates to develop bifunctional catalysts due to their good stability within a wide range of electrochemical window in basic solution. These materials are shown as good catalysts for either OER or HER, but it is desired that a single TMO or TMC can be an efficient catalyst for both reactions. It is believed that the electrochemical lithium reaction method can tune the material properties of certain TMO and TMC catalysts to become highly active in both OER and HER for overall water-splitting.

In some embodiments, a bifunctional TMO or TMC electrocatalyst is formed by subjecting to at least one galvanostatic lithiation/delithiation cycles, such as 1-10 or 1-5 galvanostatic lithiation/delithiation cycles. In some embodiments, the electrocatalyst is subjected to 1-3 galvanostatic lithiation/delithiation cycles. In some embodiments, the electrocatalyst is subjected to 2 or more galvanostatic lithiation/delithiation cycles. In some embodiments, each galvanostatic lithiation/delithiation cycles includes a lithiation phase and a delithiation phase.

In some embodiments, the electrocatalyst comprises at least one transitional metal selected from iron (Fe), cobalt (Co), and nickel (Ni). In some embodiments, the electrocatalyst comprises at least one transition metal selected from copper (Cu), manganese (Mn), titanium (Ti), niobium (Nb), molybdenum (Mo), silver (Ag), cadmium (Cd), ruthenium (Ru), platinum (Pt), and iridium (Ir). In some embodiments, the electrocatalyst comprises an oxide or a chalcogenide of at least one transition metal other than a noble metal, such as selected from Groups 3, 4, 5, 6, 7, 8, 9, 10, 11, and 12 of the Period Table and other than ruthenium, rhodium, palladium, silver, osmium, iridium, platinum, and gold. In some embodiments, the electrocatalyst comprises an oxide or a chalcogenide of two or more different transition metals, such as selected from the foregoing listed transition metals.

In some embodiments, the electrocatalyst comprises at least one TMO selected from cobalt oxide (e.g., CoO), nickel oxide (e.g., NiO), iron oxide (e.g., $Fe_3O_4$), and a mixed oxide of nickel and iron (e.g., $Ni_3FeO_x$, where x is a range of about 4 to about 4.5). In some embodiments, the electrocatalyst comprises at least one TMO selected from $Cu_2O$, CuO, $Mn_3O_4$, $Mn_2O_3$, $MnO_2$, $MoO_3$, $Ag_2O$, CdO, $RuO_2$, $IrO_2$, and $PtO_2$.

In some embodiments, the electrocatalyst comprises at least one TMC selected from $NiS_2$, $CoS_2$, and $FeS_2$.

In some embodiments, the electrocatalyst comprises nanoparticles of at least one TMO or TMC. In some embodiments, the electrocatalyst comprises interconnected crystalline nanoparticles. In some embodiments, the interconnected crystalline nanoparticles have different crystalline orientations.

In some embodiments, the electrocatalyst comprises nanoparticles having at least one lateral dimension of about 5-100 nm, or about 10-50 nm, or about 15-30 nm, or about 20 nm, before the galvanostatic lithiation/delithiation cycles.

In some embodiments, the electrocatalyst comprises ultra-small interconnected crystalline nanoparticles having at least one lateral dimension of about 1-10 nm, or about 1-5 nm, or about 2-5 nm, or about 2-4 nm, after the galvanostatic cycles.

In some embodiments, the galvanostatic lithiation/delithiation cycles are applied to the electrocatalyst at a voltage of about 0.4 V to about 4.3 V or about 0.4 V to about 3 V.

In some embodiments, the galvanostatic lithiation/delithiation cycles are applied to the electrocatalyst at a current of about 62.5 mA/g to about 250 mA/g, based on the mass of the TMO or TMC.

In some embodiments, the electrocatalyst comprises TMO or TMC nanoparticles disposed on a carbon-based substrate. In some embodiments, the electrocatalyst comprises TMO or TMC nanoparticles disposed on a carbon-based substrate selected from CNFs and CFP. In some embodiments, the electrocatalyst comprises TMO or TMC nanoparticles disposed on a substrate selected from graphene, carbon nanotubes, carbon black, porous graphite, carbon felt, and nickel foam.

In some embodiments, the electrocatalyst comprises TMO or TMC nanoparticles disposed on a carbon-based substrate at a mass loading of about 0.5-20 mg/cm$^2$, or about 1-10 mg/cm$^2$, or about 1-5 mg/cm$^2$, or about 1.5-3 mg/cm$^2$.

In some embodiments, the electrocatalyst is a bifunctional catalyst adapted to catalyze both OER and HER in an electrolyte.

In some embodiments, the electrocatalyst is adapted to generate at least about 10 mA/cm$^2$ OER anodic current in about 1 M KOH at about 1.8 V or lower vs RHE, or about 1.7 V or lower vs RHE, about 1.6 V or lower vs RHE, about 1.5 V or lower vs RHE, for at least 100 hours, or at least 200 hours, or at least 500 hours of continuous operation. In some embodiments, the electrocatalyst is adapted to generate at least about 10 mA/cm$^2$ OER anodic current in about 1 M KOH at about 1.45 V or lower vs RHE, for at least 200 hours of continuous operation.

In some embodiments, the electrocatalyst is adapted to generate at least about 10 mA/cm$^2$ overall water-splitting current in about 1 M KOH at about 1.8 V or lower, or about 1.7 V or lower, about 1.6 V or lower, about 1.5 V or lower, for at least 100 hours, or at least 200 hours, or at least 500 hours of continuous operation. In some embodiments, the electrocatalyst is adapted to generate at least about 10 mA/cm$^2$ overall water-splitting current in about 1 M KOH at about 1.55 V or lower, for at least 200 hours of continuous operation.

The method of some embodiments of the present disclosure involves a conversion reaction mechanism between Li and TMOs or TMCs to improve the catalytic behavior. TMOs are used here as an example. Conversion reaction ($MO+2\ Li^+ + 2\ e^- \leftrightarrows M+Li_2O$) takes place by breaking the M-O bonds and forming M-M and Li—O bonds, which is different from the interaction mechanism (FIGS. 1A-1B). Conversion reaction can cause dramatic change in the MO materials. Once lithium is extracted to reform MO, the initial MO particles would transform into much smaller ones with few nanometers in diameter (FIGS. 1B-1C). This morphological transformation opens up opportunities to increase the surface area of TMOs tremendously. With a relative small number of lithium galvanostatic cycles, these small particles can be maintained interconnected (FIGS. 1C-1D). It is believed that the ultra-small, interconnected TMO nanoparticles present an ideal structure for highly active and stable electrocatalytic water-splitting because they 1) create a great number of grain boundaries as active centers, 2) expose additional catalytically active sites, and 3) strongly interact with each other during the delithiation reaction process which helps to maintain good mechanical and electrical contacts. However, a large number of battery cycles may break off the particles, resulting in the loss of connection and form a thick solid electrolyte interface (SEI) covering the surface, which could induce negative effects on the catalytic performance of TMOs (FIG. 1E). Therefore, it is sometimes desirable to maintain a relative low number of battery cycles to select the most active catalyst.

Specifically described here is the general efficacy of lithium galvanostatic cycling in improving OER catalytic activities of TMOs (M=Fe, Co, Ni, and their mixture). High-performance OER catalyst is then selected to show the enhanced HER activity. With two reactions greatly improved by the galvanostatic cycling method, efficient and stable overall water-splitting by the bifunctional catalyst is presented.

Figure 2:
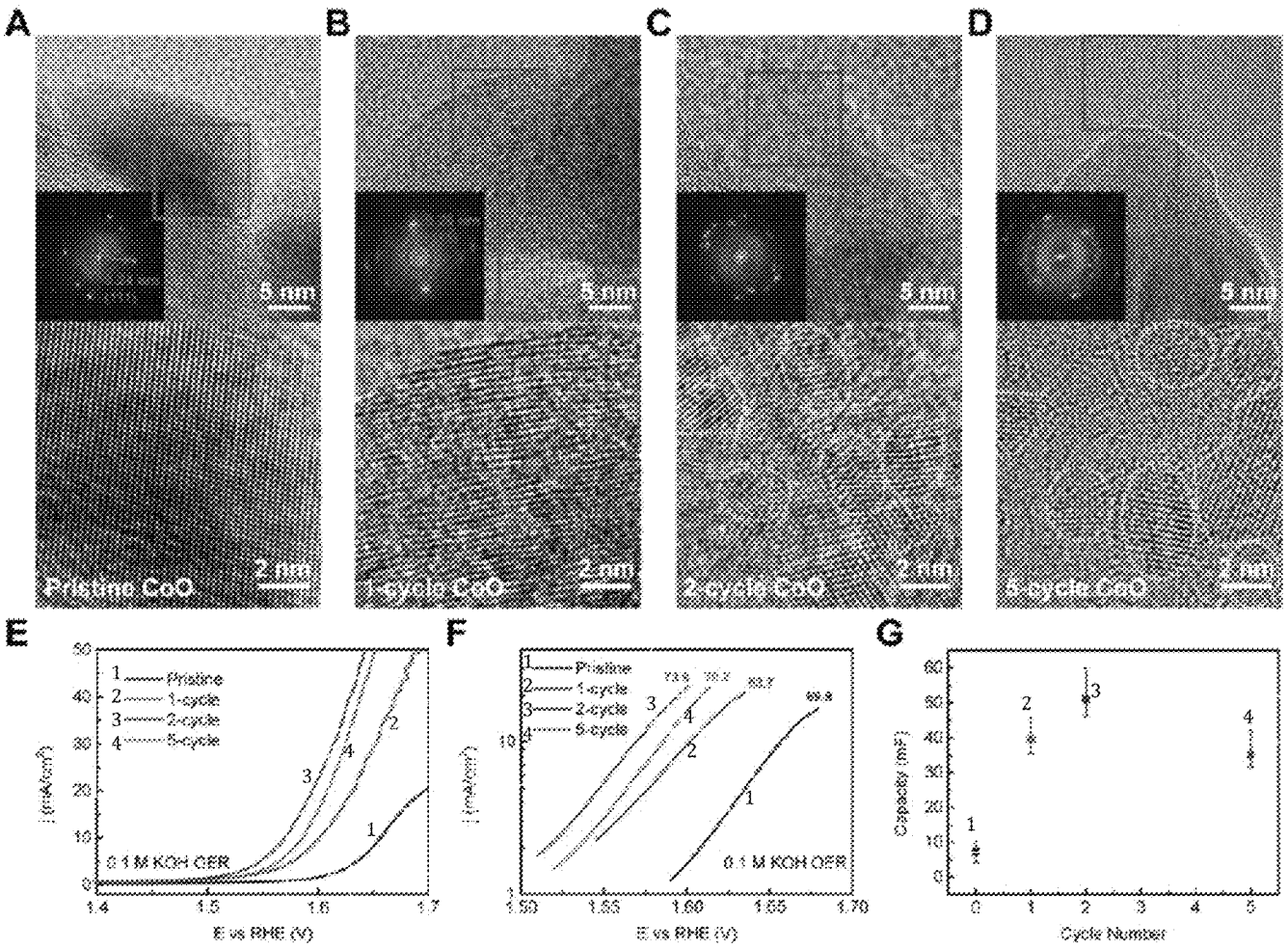
FIG. 2 shows transmission electron microscope (TEM) images and the corresponding OER activities of CoO/CNF with different galvanostatic cycles. (A) TEM image of pristine CoO/CNF. The lattice structure and the fast Fourier transform (FFT) pattern indicate the single crystalline nature of the pristine particle. (B) With a blurred lattice orientation still visible, TEM image of 1-cycle CoO/CNF exhibits defects, lattice distortions, and expanded (111) spacing. (C) TEM image of 2-cycle CoO/CNF shows ultra-small, interconnected nanoparticles that have sizes from about 2 nm to about 5 nm. (D) TEM image of 5-cycle CoO/CNF shows similar domain size to the 2-cycle one. The dash line in the upper image represents the boundary of the whole particle. The zoom-in image indicates the detachment of the ultra-small nanoparticles from the mother particle. (E) OER catalytic activities of CoO/CNF on carbon fiber paper (CFP) in about 0.1 M KOH under different galvanostatic cycles. The polarization scan rate is about 5 mV/s. 2-cycle CoO/CNF gives the best performance. (F) The Tafel plots of OER polarization curves. (G) Electrochemical double layer capacitance (ECDLC) of CoO/CNF under different cycles. Three identical samples are tested for each cycle number.
Figure 5:
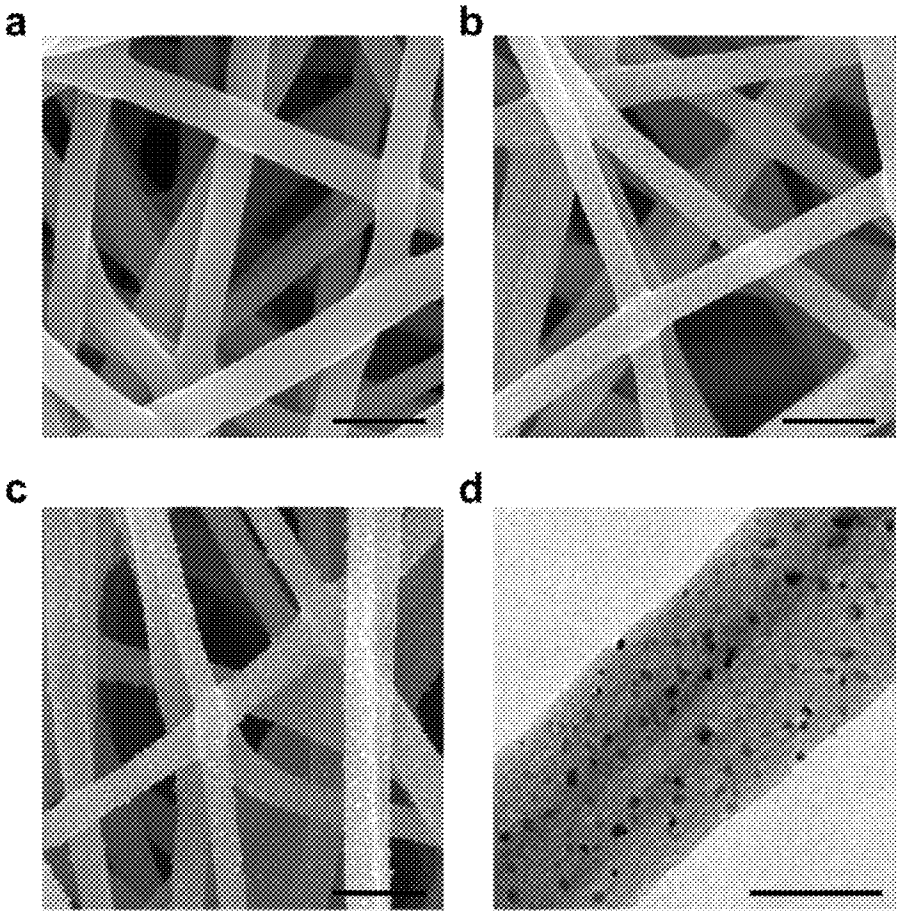
FIG. 5 shows scanning electron microscope (SEM) and TEM images of CoO/CNF before and after galvanostatic cycles. (a) SEM image of CNF. (b) SEM image of CoO nanoparticles uniformly distributed on CNF. (c) SEM image of 2-cycle CoO/CNF. (d) TEM image of pristine CoO/CNF indicating the uniform sizes and distributions of the nanoparticles. Scale bars: (a), (b), (c), 500 nm; (d), 200 nm.
Figure 6:
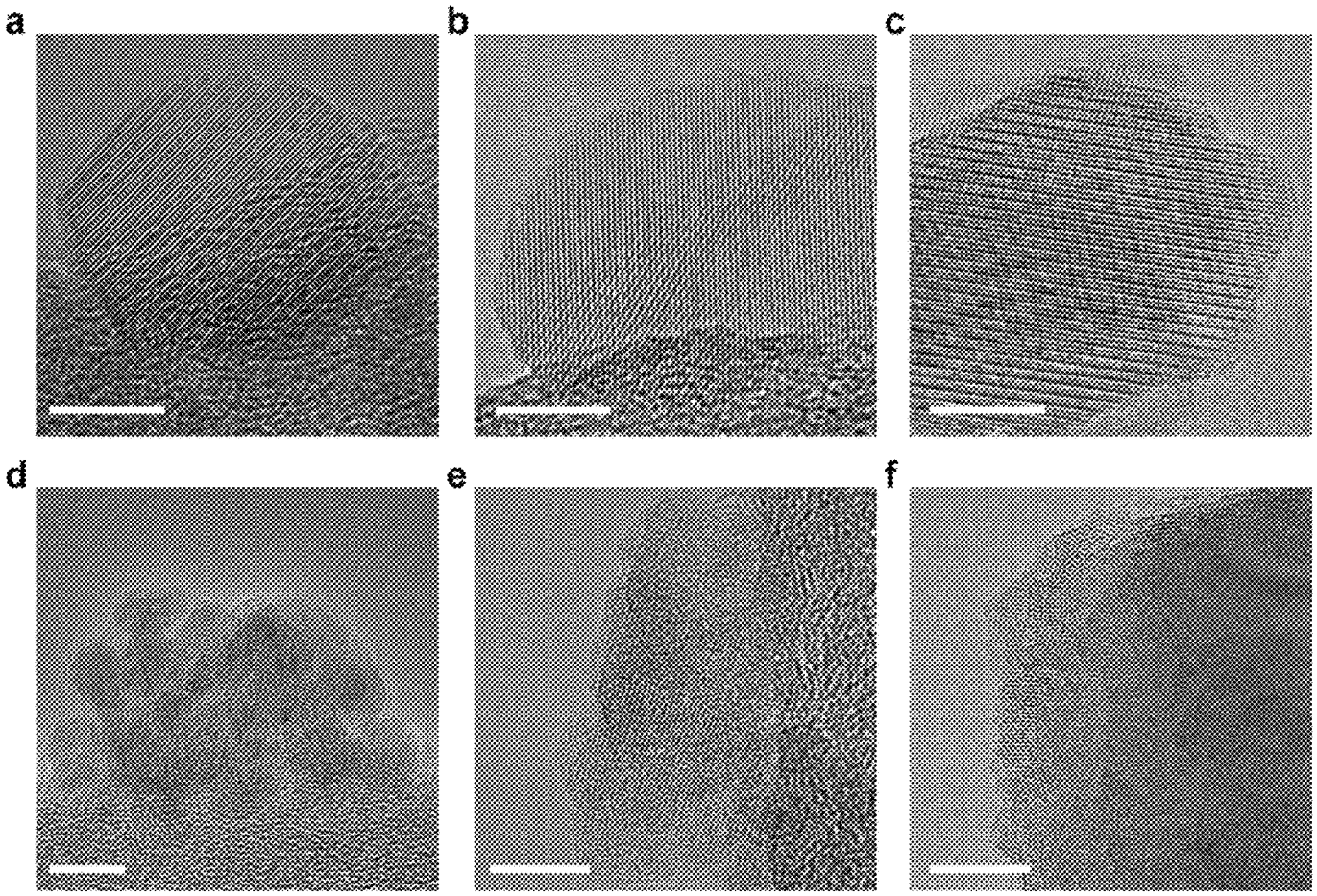
FIG. 6 shows TEM images of TMOs before and after 2 battery cycles. (a), (d) TEM images of pristine and 2-cycle NiO/CNF, respectively. (b), (e) TEM images of pristine and 2-cycle $Fe_3O_4$/CNF, respectively. (c), (f) TEM images of pristine and 2-cycle $Ni_3FeO_x$/CNF, respectively. All of the transition metal oxides including CoO/CNF in FIG. 2 show the transformation from monocrystalline particles into ultra-small interconnected crystalline nanoparticles. Scale bars: 5 nm.
Figure 7:
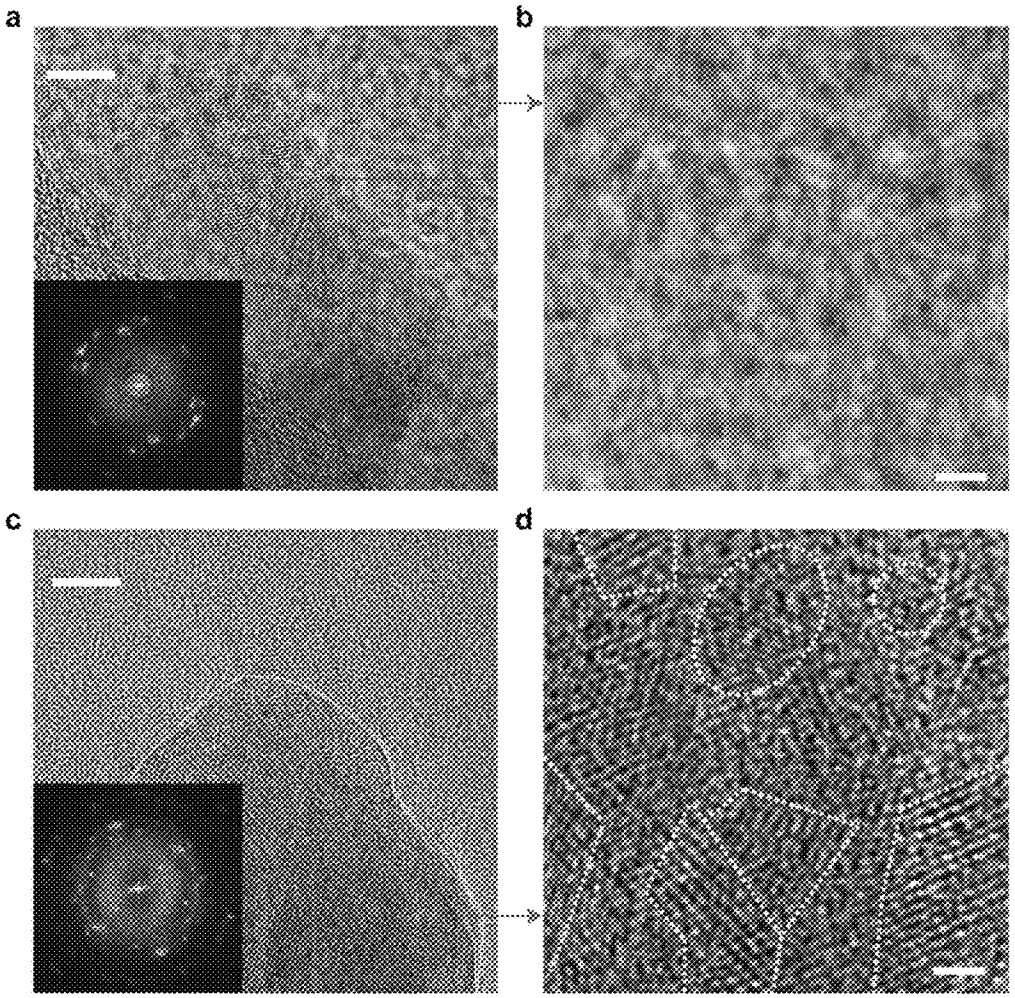
FIG. 7 shows TEM images of 2-cycle and 5-cycle CoO/CNF. (a), (b) The zoomed-in area away from the 2-cycle CoO particle is featureless, indicating that the ultra-small nanoparticles are strongly interconnected. (c), (d) The zoomed-in area of 5-cycle CoO particle indicates the domain size of the ultra-small nanoparticles is similar to the 2-cycle CoO/CNF samples. Scale bars: (a), (c), 5 nm; (b), (d), 1 nm.
Figure 8:
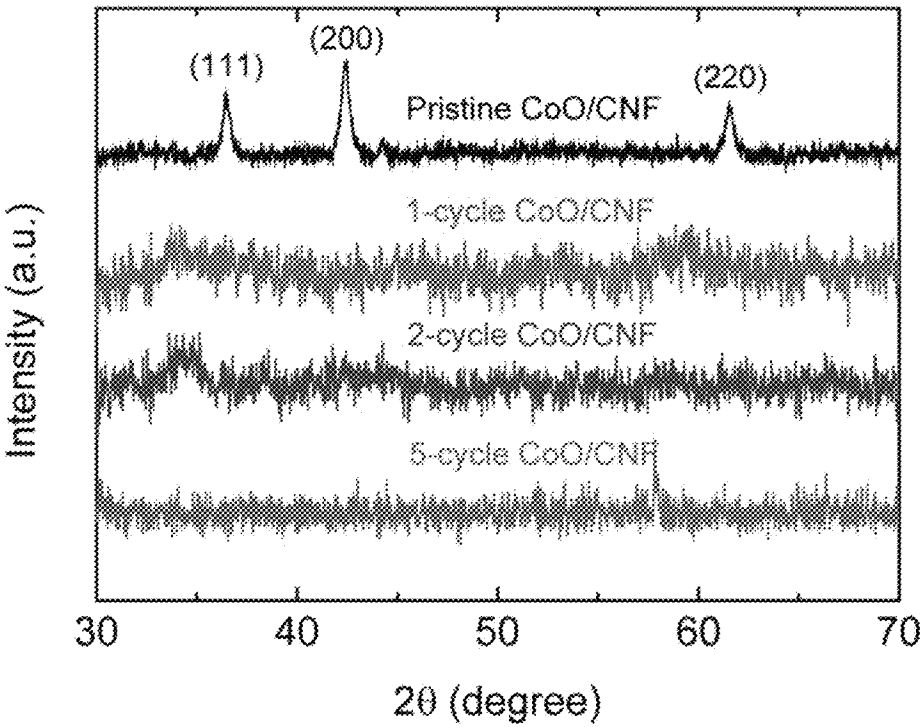
FIG. 8 shows X-ray diffraction (XRD) spectra of pristine, 1-cycle, 2-cycle, and 5-cycle CoO/CNF. Pristine CoO/CNF shows three distinguished peaks representing (111), (200), and (220) surfaces. The XRD spectra of other samples after galvanostatic cycling are featureless, indicating that the sizes of the nanoparticles are below the coherence length of the X-ray.
Figure 9:
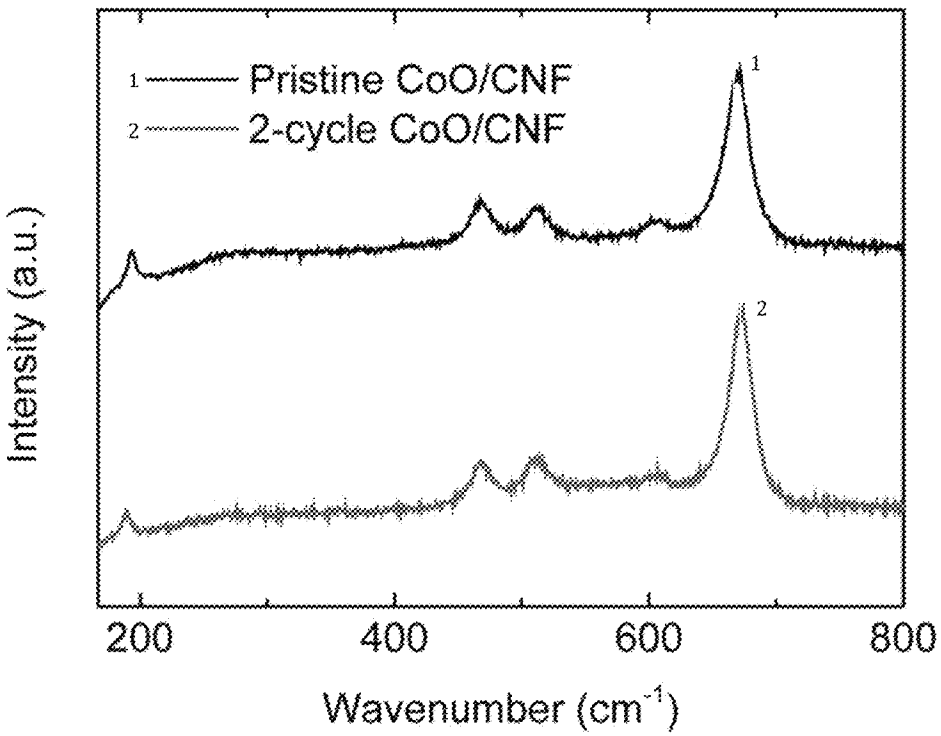
FIG. 9 shows Raman spectra of pristine and 2-cycle CoO/CNF. The distinguished peaks before and after galvanostatic cycling are similar, indicating that the chemical composition and the phase of CoO are not changed after the cycling process. In addtion, no broadening of the peaks is observed even though the particles sizes are significantly reduced. This might be related to the specific structure after the treatment of battery cycling. Different from separated particles, the ultra-small nanoparticles are strongly connected with each other and form an integrated secondary particle (TEM images in FIG. 2). The grain boundary conditions of those ultra-small nanoparticles are therefore different from the case of separated particles. The strongly interacted boundaries may help to enhance the long distance translational periodicity, resulting in a similar Raman spectrum to the pristine one.

First, CoO nanoparticles were grown on CNFs to assess the morphology evolutions and the corresponding improvements in OER activities under different galvanostatic cycle numbers. The pristine CoO nanoparticles are about 20 nm in diameter and uniformly distributed on CNFs (FIG. 5, this sample is denoted as pristine CoO/CNF). TEM images and the corresponding FFT patterns indicate the monocrystalline nature of pristine CoO nanoparticles (FIG. 2A). The spacing of (111) atomic planes is measured to be about 0.24 nm. The CoO/CNF was then assembled in a lithium-ion battery pouch cell for galvanostatic lithiation (charge) and delithiation (discharge) processes (FIG. 1F). Small charge/discharge current (compared with regular battery cycling) was selected for thorough reaction, which also helps to maximally maintain the integration of the particles for long-term stability. The morphology of CoO begins to change after one cycle of the charge/discharge process (the cycled samples were denoted as 1-cycle, 2-cycle, and 5-cycle CoO/CNF). While the whole lattice are still visible, the fringes become curvy and loose compared with pristine CoO (FIG. 2B). Defects are created during the cycling process, as indicated by the blurred areas present in the zoomed-in TEM image. The average (111) spacing of 1-cycle CoO is about 0.26 nm, slightly expanded from the pristine of about 0.24 nm. This lattice expansion and distortion in the first cycle lower the energy barrier for a small lattice domain to change orientation, preparing for the large particle to be further transformed into smaller particles in the following cycles. The TEM images of 2-cycle CoO/CNF show that the monocrystalline CoO particle is converted into interconnected crystalline nanoparticles, with ultra-small sizes about 2 nm (FIG. 2C). The FFT pattern with significantly more diffraction spot patterns than pristine CoO also indicates that many lattice orientations are present in this single CoO particle. The ultra-small nanoparticles create boundaries, defects, and dislocations, which are considered to be active sites of electrocatalysis. Two neighboring nanoparticles merge together at the boundary without any visible gaps present, indicating that they are strongly interconnected with each other which ensures good electrical and mechanical contact for efficient and stable catalysis. Similar structures are also observed in NiO, FeO, and $Ni_3FeO_x$ nanoparticles (FIG. 6). As indicated by the TEM images of 5-cycle CoO/CNF (FIG. 2D and FIG. 7), further cycles do not significantly reduce the sizes of the interconnected nanoparticles or even convert them into amorphous structures, indicating that ultra-small nanoparticles have reached the minimum domain sizes under the specific cycling condition. In areas away from the integrated particle, it was observed that several ultra-small CoO crystals are detached, which indicates that more cycling number could adversely impact the integration of the whole particle and may also loosen the contacts between the interconnected nanoparticles. XRD spectroscopy of pristine CoO has three distinguished peaks, which however disappear in the battery cycled samples (FIG. 8), indicating that the sizes of the interconnected nanoparticles are below the X-ray coherence length. Raman spectra of pristine and 2-cycle CoO/CNF confirm that the phase of CoO is not changed after the battery cycling process (FIG. 9).

Figure 10:
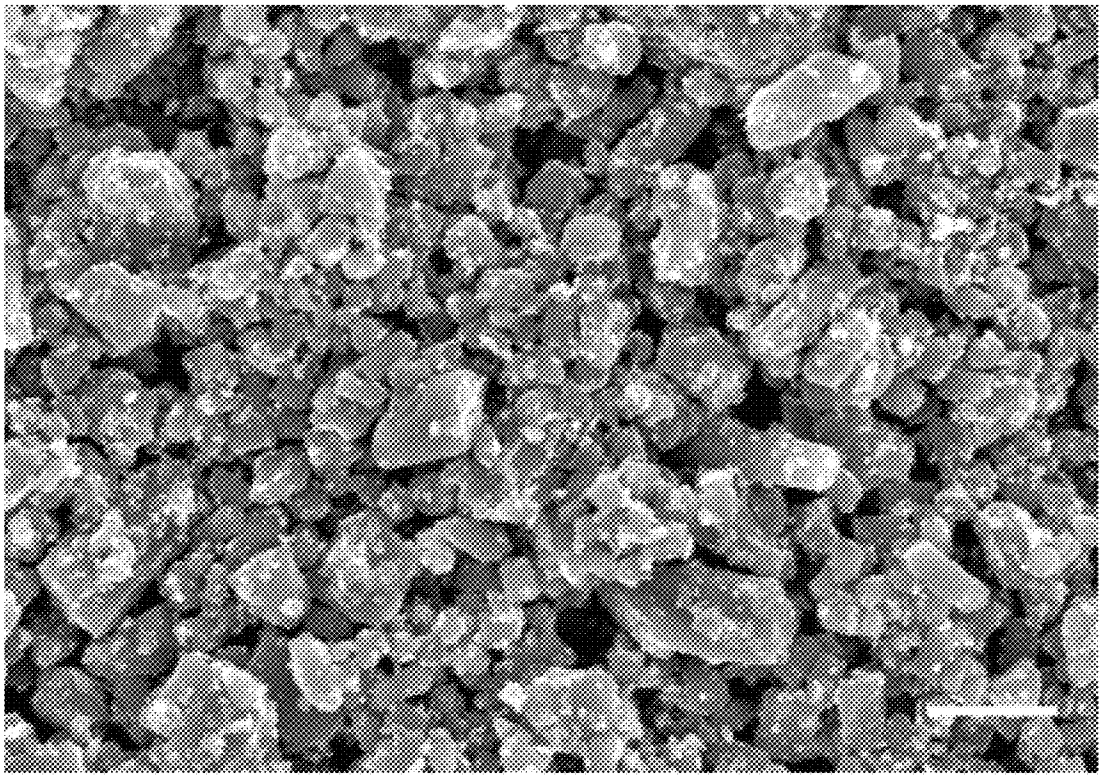
FIG. 10 shows a SEM image of ball milled CoO/CNF particles with sizes ranging from about 200 nm to about 1 μm. Scale bar: 1 μm.
Figure 11:
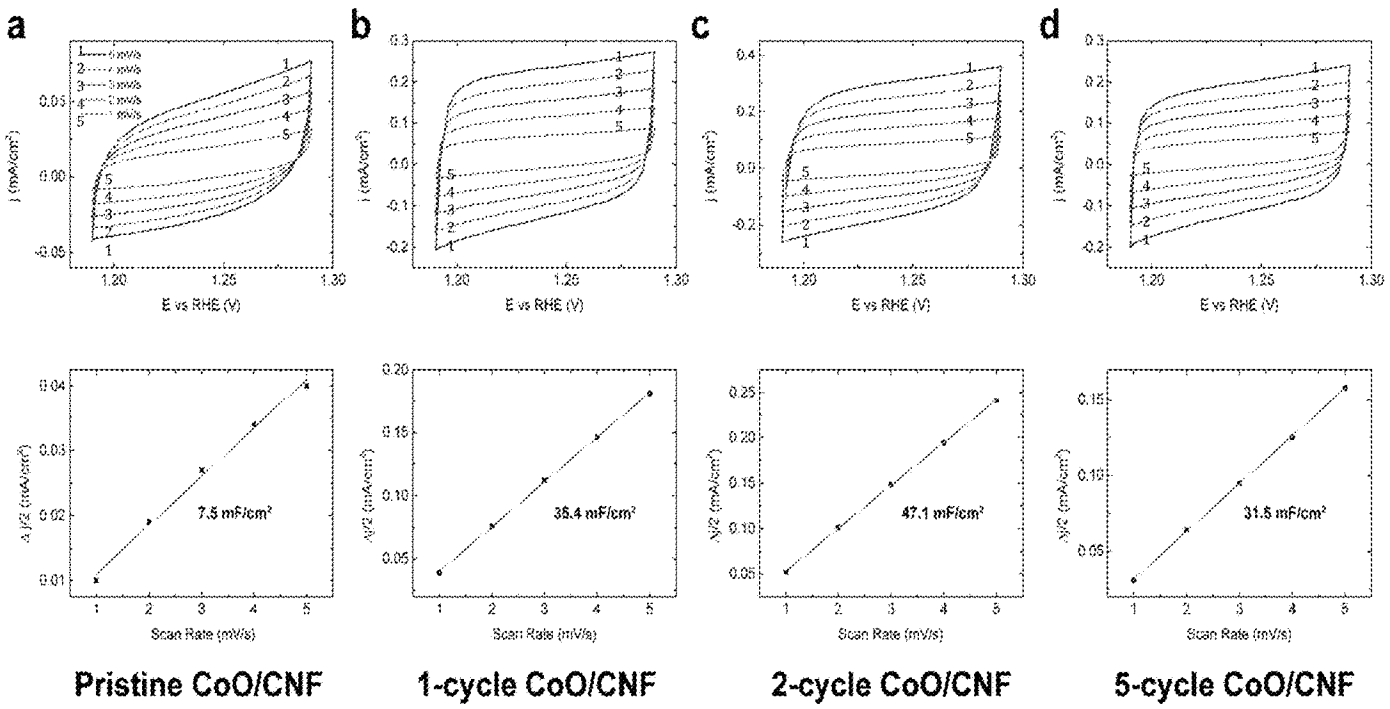
FIG. 11 shows ECDLC measurements of CoO/CNF samples. (a) ECDLC of pristine CoO/CNF with a capacitance of about 7.5 mF/cm$^2$. (b) ECDLC of 1-cycle CoO/CNF with an increased capacitance of about 35.4 mF/cm$^2$. (c) 2-cycle CoO/CNF shows the highest capacitance of about 47.1 mF/cm$^2$. (d) The ECDLC of 5-cycle CoO/CNF slightly decreases from its 2-cycle counterpart, with a capacitance of about 31.5 mF/cm$^2$.
Figure 12:
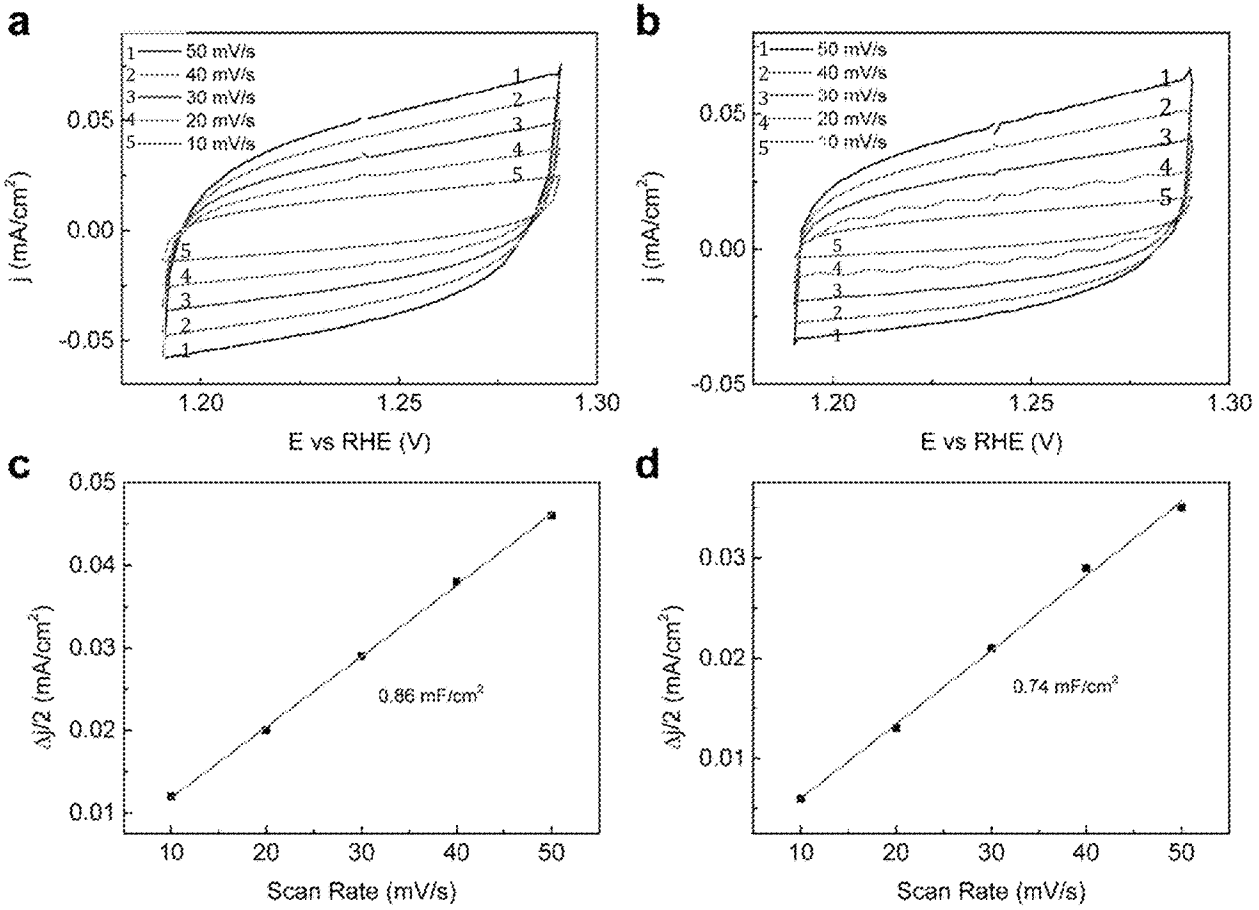
FIG. 12 shows ECDLC measurements of CNF backgrounds before and after 2 battery cycles. (a), (c) ECDLC of pristine CNF loaded on CFP with a capacitance of about 0.86 mF/cm$^2$. (b), (d) ECDLC of 2-cycle CNF on CFP with roughly the same capacitance of about 0.74 mF/cm$^2$. Both capacitances are negligible compared with the catalysts in FIG. 11.
Figure 13:
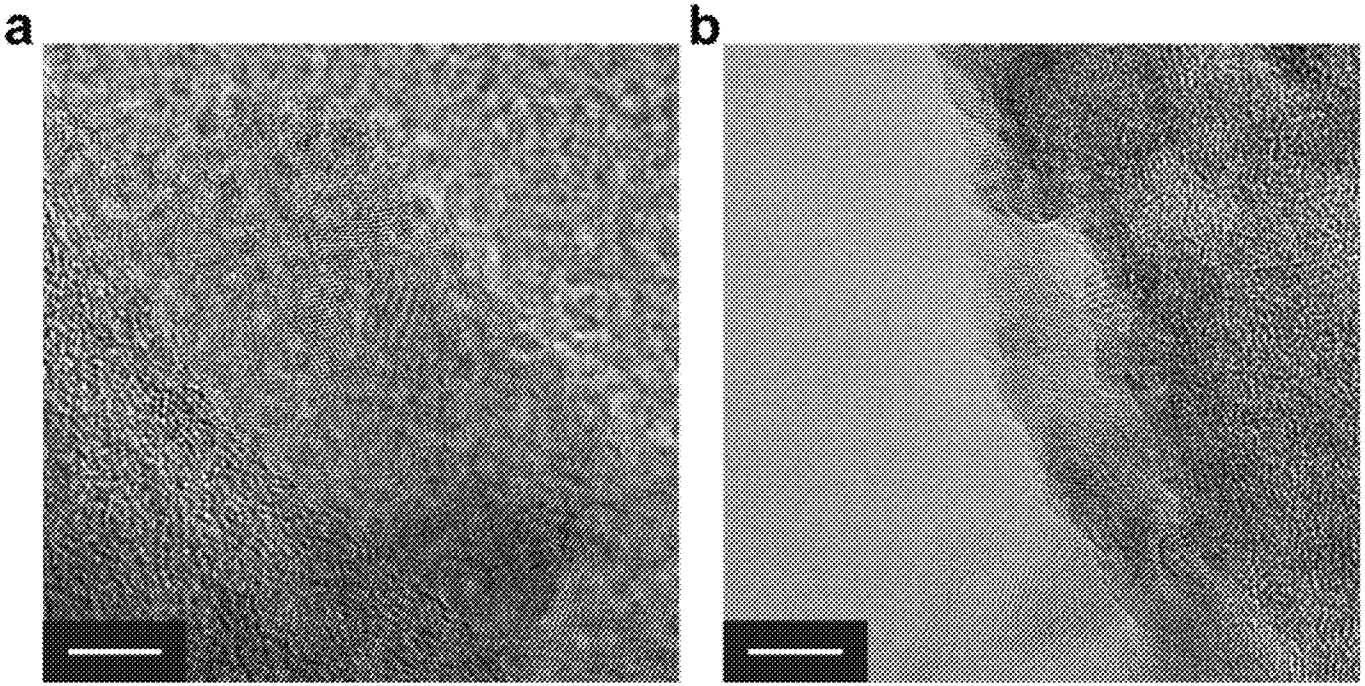
FIG. 13 shows TEM images of 2-cycle CoO/CNF before and after OER. (a) TEM image of 2-cycle CoO/CNF. (b) TEM image of 2-cycle CoO/CNF after oxygen evolution under a potential of about 1.65 V vs RHE for over 30 minutes. The structures of interconnected crystalline nanoparticles are well maintained, and their sizes are not significantly changed compared with the sample before OER. This indicates that it is less likely for the amorphization process to take place under the OER condition. Scale bars: 5 nm.
Figure 14:
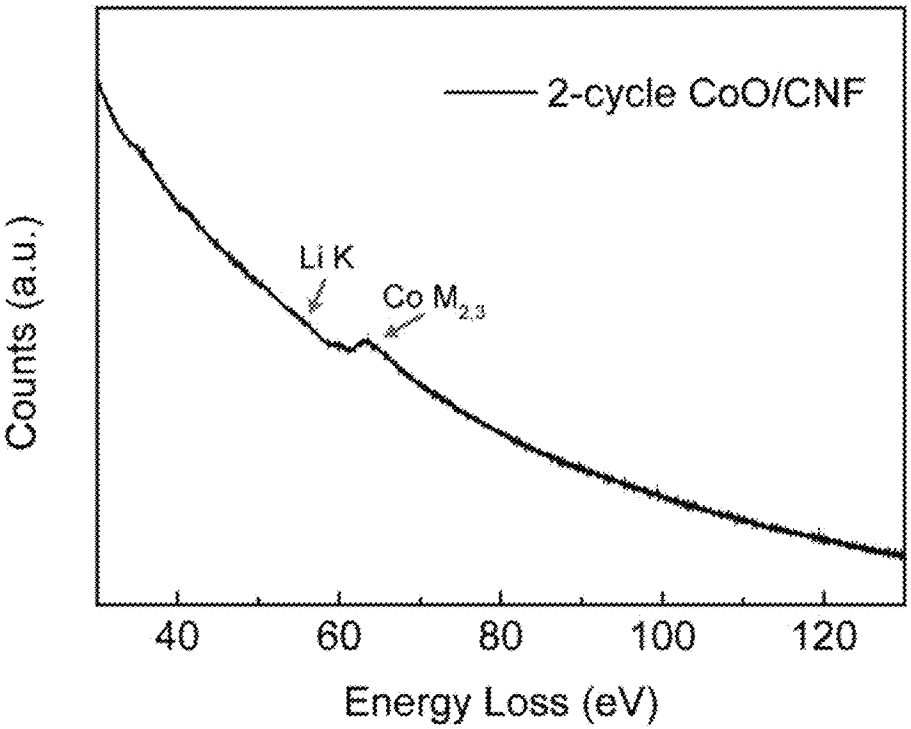
FIG. 14 shows electron energy loss spectroscopy (EELS) of 2-cycle CoO/CNF. No observable Li K edge is shown, indicating that the amount of residual Li is below the detection limit of EELS.
Figure 15:
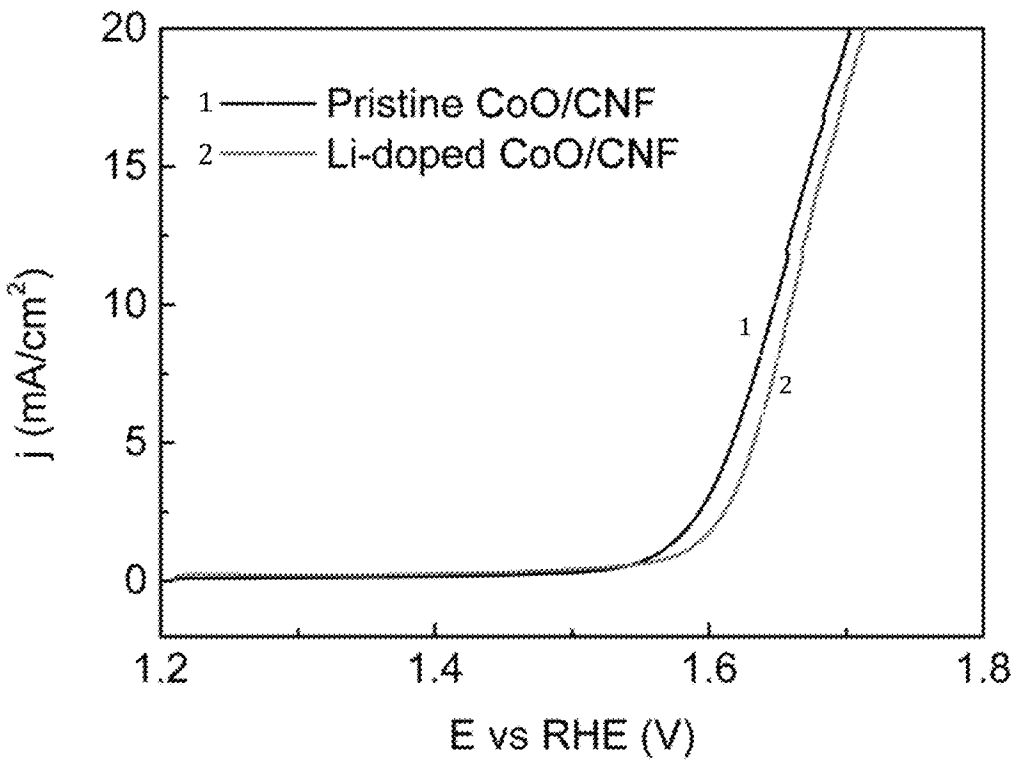
FIG. 15 shows OER activities of pristine and Li-doped CoO/CNF. To shed light on how Li doping influences the catalytic activities, CoO/CNF was doped with Li by charging the electrode to about 1 V vs $Li^+$/Li (right above the conversion reaction plateau, Li to Co ratio was determined to be about 1:7 by inductively coupled plasma mass spectrometry (ICP-MS)). The OER performance shows a slight decay compared with pristine CoO/CNF, indicating that Li doping does not contribute to the improvement in OER performance.

To examine the electrochemical OER catalytic activities, pristine CoO/CNF was drop casted onto commercial CFP substrates (FIG. 10), followed by 1, 2, and 5 galvanostatic cycles respectively. The as-prepared catalysts were tested in about 0.1 M KOH solution. All of the potentials are referred to RHE and have been iR-corrected unless noted. Pristine CoO/CNF shows a sluggish OER process with an onset potential of about 1.59 V and a Tafel slope of about 69.8 mV/decade (FIG. 2E). The activity of 1-cycle CoO/CNF is significantly improved, achieving a reduced onset potential of about 1.55 V while exhibiting a slightly increased Tafel slope of about 83.7 mV/decade (FIG. 2F). The increased surface area, atomic defects and distortions created during the first cycle in FIG. 2B are considered to contribute to the improved catalytic activity. The OER performance is continuously improved after 2 galvanostatic cycles, as additional surface areas and active sites are introduced by those ultra-small interconnected nanoparticles (FIGS. 2C and 2E). While the Tafel slope (about 73.6 mV/decade) of 2-cycle CoO/CNF is not changed much, the onset potential is further lowered to about 1.51 V, significantly improving the OER activity which reaches about 10 $mA/cm^2$ anodic current at about 1.57 V. 5-cycle CoO/CNF shows a degraded OER performance compared with the 2-cycle sample (FIG. 2F), consistent with the analysis of the TEM image (FIG. 2D) that some of the ultra-small nanoparticles are detached from and lose electrical contact with the mother particle. The electrochemical double layer capacities of the catalysts, which represent the active surface areas, are obtained by applying cyclic voltammograms at a series of scanning rates (FIG. 2G and FIGS. 11-12). The trend of the capacity versus the cycle number agrees well with that of the OER activity, where 2-cycle CoO/CNF exhibits the largest capacity. Therefore, two galvanostatic cycles may be an optimized condition for improving the catalytic performance of as-synthesized TMO nanoparticles. While the conversion from monocrystalline particle to polycrystalline nanoparticles helps to significantly increase the active sites and surface areas, whether those ultra-small crystalline nanoparticles become amorphous under the OER conditions is worth to be further examined. The TEM image of 2-cycle CoO/CNF after OER catalysis is shown in FIG. 13, in which the structures and sizes of interconnected crystalline nanoparticles are well maintained and no noticeable sign of amorphization process is observed. No Li signal is observed in 2-cycle CoO/CNF by EELS as shown in FIG. 14, indicating that the concentration of residual Li is lower than the EELS detection limit. In addition, the molar ratio of Li to Co in 2-cycle CoO/CNF is determined to be about 1:23.4 by inductive coupled ICP-MS, indicating the negligible amount of residual Li after the cycling process. To shed light on how Li doping influences the catalytic activities, CoO/CNF was doped with Li by charging the electrode to about 1 V vs $Li^+/Li$ (right above the conversion reaction plateau, Li to Co ratio was determined to be about 1:7 by ICP-MS). The OER performance shows a slightly decay compared with pristine CoO/CNF in FIG. 15, indicating that Li doping does not contribute to the improvement in OER performance. Combined with the analysis of the great contributions from the increased surface areas as well as capacitances, it is therefore indicated that the very small amount of residual Li does not play a significant role in improving the OER catalysis.

Figure 16:
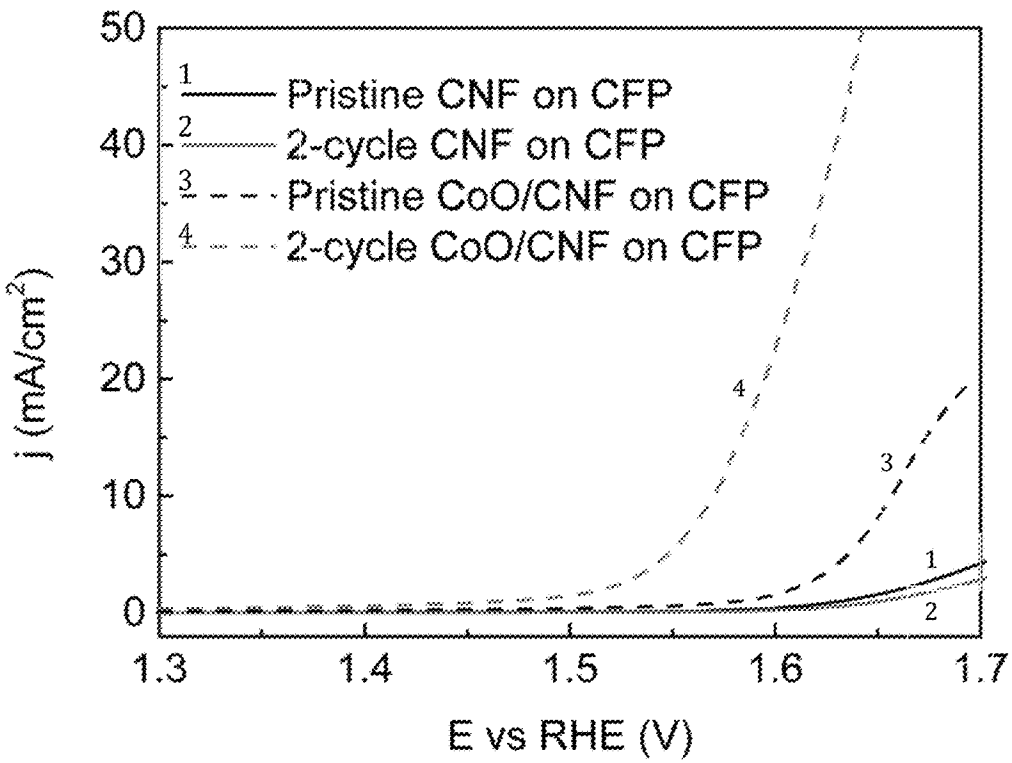
FIG. 16 shows OER background testing of pristine and 2-cycle CoO/CNF loaded on CFP. The backgrounds are negligible compared with pristine and 2-cycle CoO/CNF catalysts.
Figure 17:
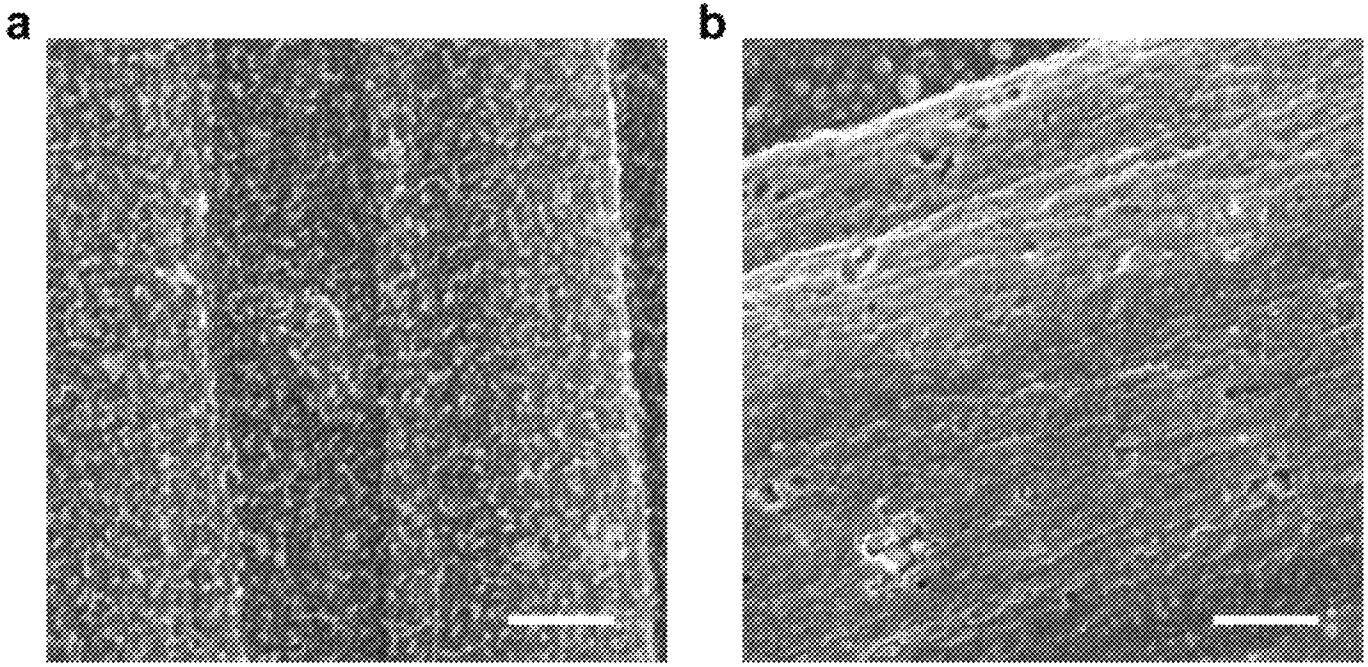
FIG. 17 shows SEM images of (a) pristine, and (b) 2-cycle CoO/CFP. Scale bars: 200 nm.
Figure 18:
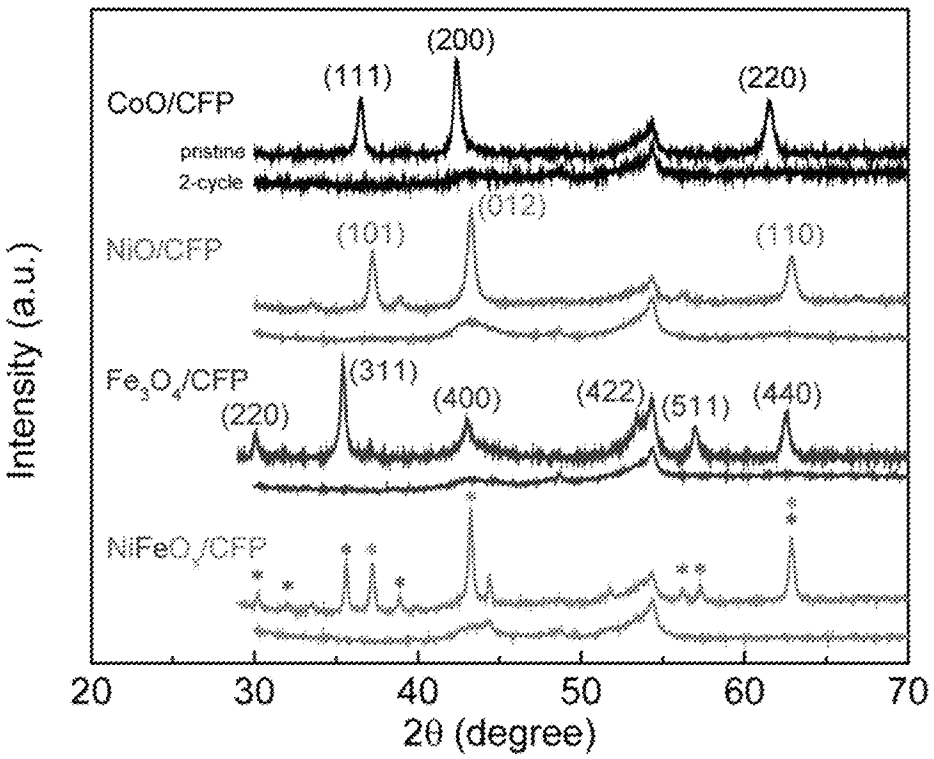
FIG. 18 shows XRD spectra of pristine and 2-cycle CoO/CFP, NiO/CFP, $Fe_3O_4$/CFP, and $Ni_3FeO_x$/CFP. The resulting $Fe_3O_4$ phase indicates that under the synthesis condition $Fe_3O_4$ is more stable than $Fe_2O_3$. The $Ni_3FeO_x$/CFP is actually a mixture of NiO and $Fe_2O_3$. The presence of NiO may mitigate against reduction of $Fe_2O_3$ to $Fe_3O_4$. After 2 battery cycles the patterns of TMOs become featureless, indicating the significantly reduced particle size which is below the coherence length of the X-ray.
Figure 19:
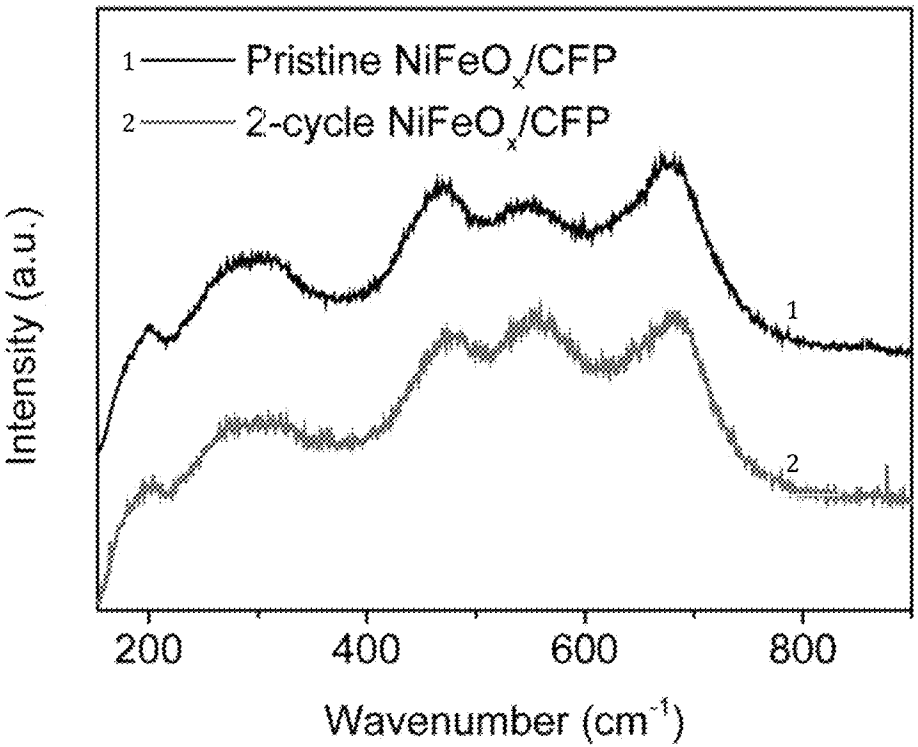
FIG. 19 shows Raman spectra of pristine and 2-cycle $Ni_3FeO_x$/CFP. There are no significant changes in the peaks after 2 battery cycles, consistent with the observation on CoO/CNF in FIG. 9.
Figure 20:
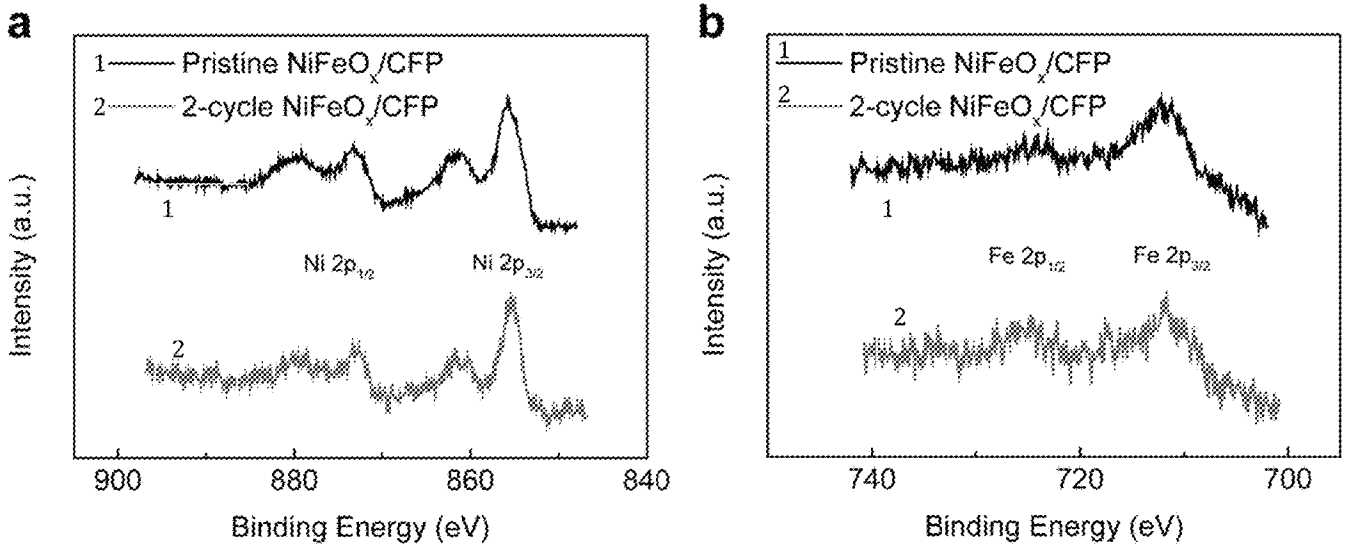
FIG. 20 shows X-ray photoelectron spectroscopy (XPS) of pristine and 2-cycle $Ni_3FeO_x$/CFP. (a) Pristine and 2-cycle $Ni_3FeO_x$/CFP show similar Ni 2p regions with both Ni $2p_{3/2}$peaks located at about 855.6 eV. (b) Pristine and 2-cycle $Ni_3FeO_x$/FP show similar Fe 2p regions with both Fe $2p_{3/2}$ peaks located at about 711.9 eV.

The possibility of background contributions was ruled out by performing battery cycling on bare CNFs in FIG. 16.

Figure 3:
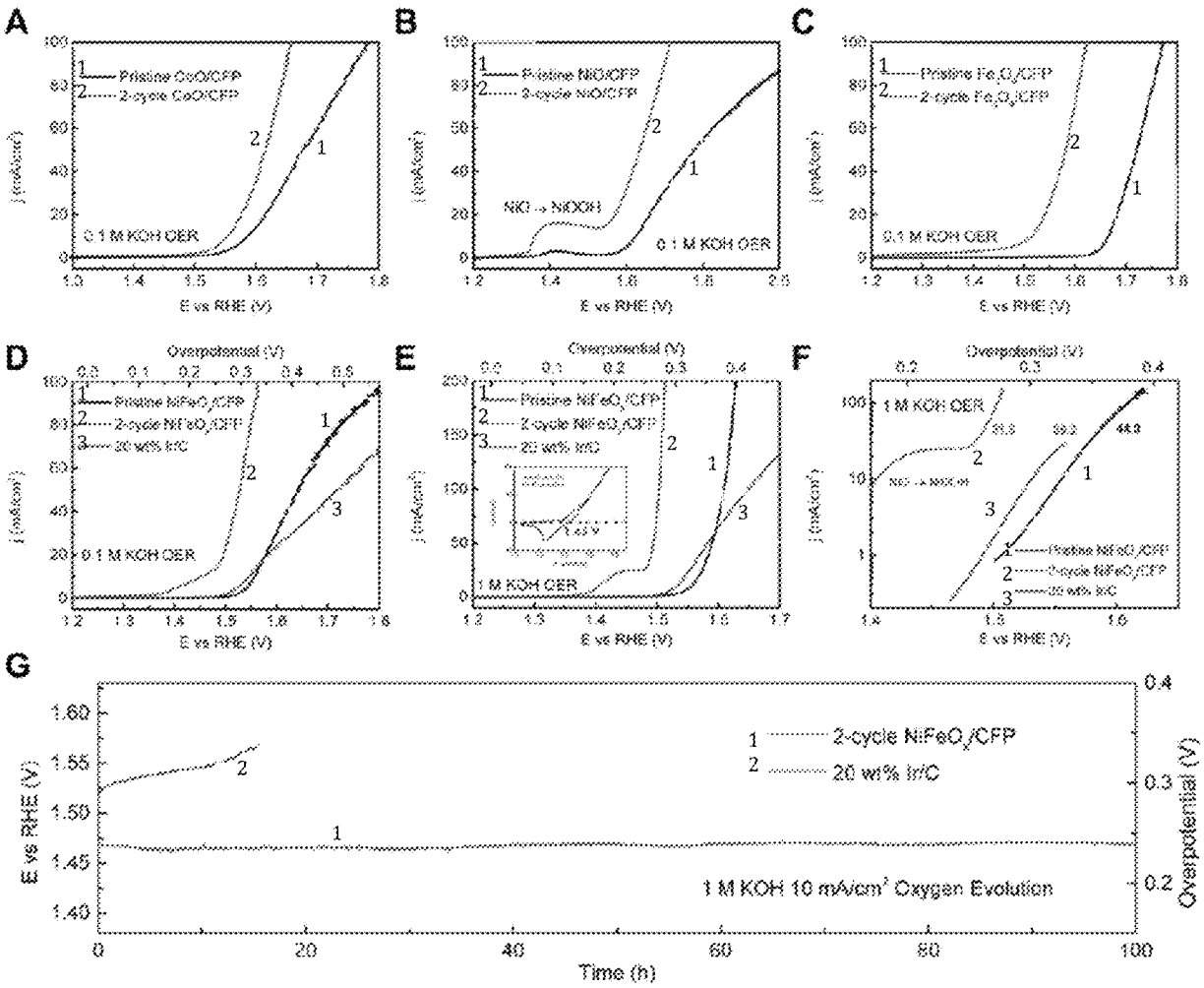
FIG. 3 shows OER activities and stability of pristine and 2-cycle TMO/CFP catalysts. (A)-(D) The general efficacy of galvanostatic cycling in improving the OER activities of Co, Ni, Fe, and NiFe oxides in about 0.1 M KOH. 2-cycle $Ni_3FeO_x$/CFP exhibits better performance than the Ir/C benchmark. (E)-(F) The OER polarization curves and the corresponding Tafel plots of pristine and 2-cycle $Ni_3FeO_x$/CFP in about 1 M KOH. The polarization scanned from positive potential to negative in the inset indicates the onset potential of 2-cycle $Ni_3FeO_x$/CFP at about 1.43 V. The Tafel slope of 2-cycle $Ni_3FeO_x$/CFP is about 31.5 mV/decade, better than the Ir/C benchmark. (G) 2-cycle $Ni_3FeO_x$/CFP exhibits an excellent OER stability, achieving about 10 mA/cm$^2$ anodic current at about 1.46 V vs Reversible Hydrogen Electrode (RHE) for over 100 hours without degradation. This is better than the Ir/C benchmark.
Figure 21:
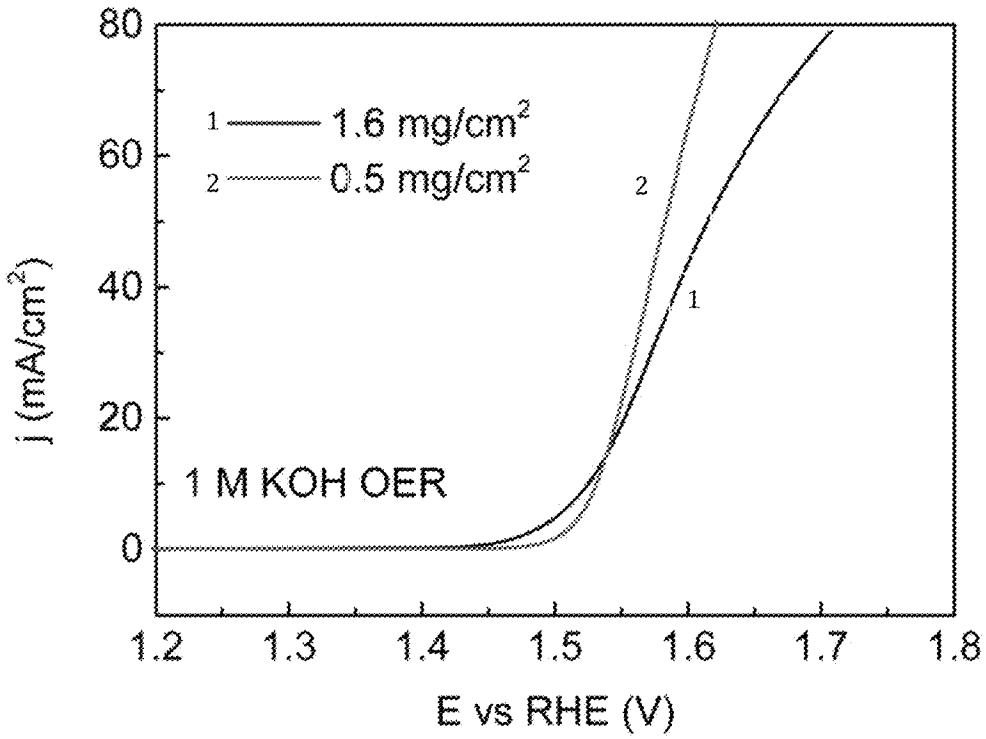
FIG. 21 shows comparison of about 0.5 mg/cm$^2$ and about 1.6 mg/cm$^2$ Ir/C loadings for OER. Even though the large loading shows a lower onset potential, its activity is surpassed by the about 0.5 mg/cm$^2$ loading when the current becomes significant. The reason could be due to the carbon additives in the commercial Ir/C catalyst. It is understood that the carbon nanoparticles have hydrophobic nature. Therefore, too much loading may result in a hydrophobic surface on the electrode. This will hamper the contact between the electrode and the electrolyte, and at the same time making it difficult for gas products to release, resulting in degraded performance under high current density.
Figure 22:
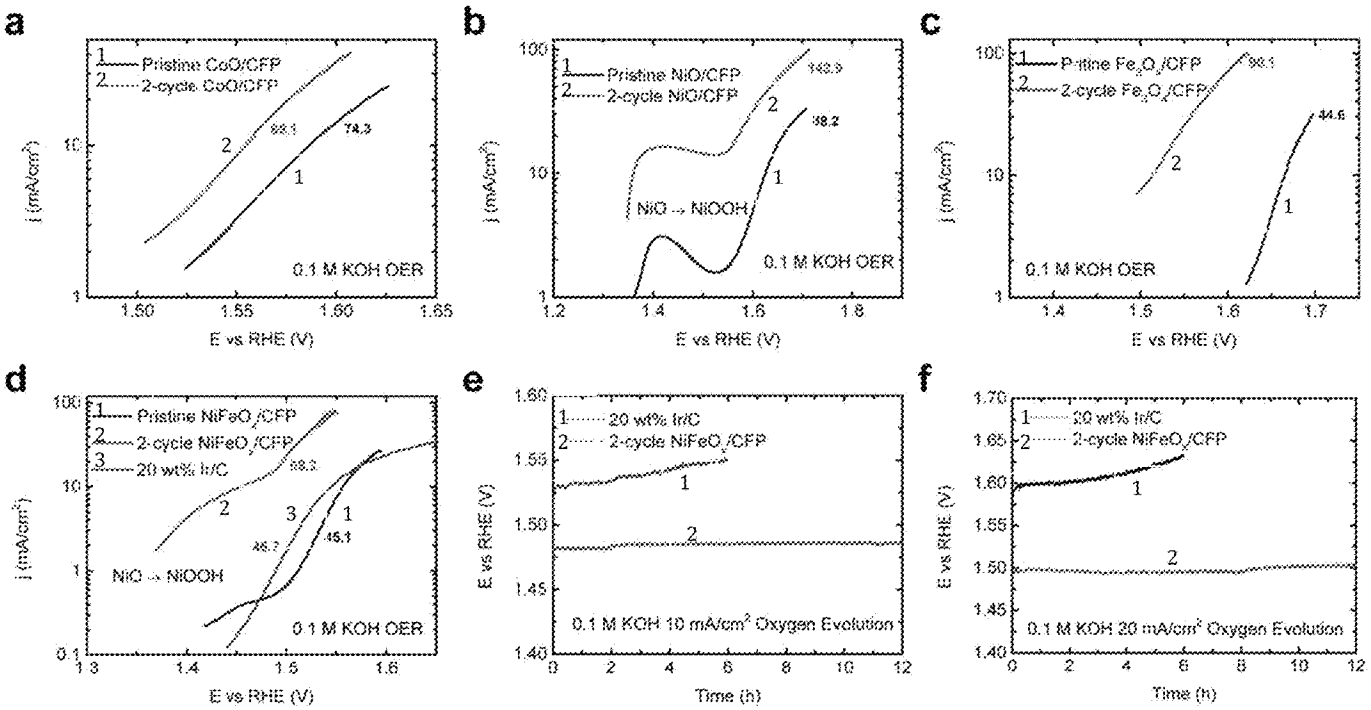
FIG. 22 shows Tafel plots and stability testing of TMO/CFP samples. (a) The Tafel plots of pristine and 2-cycle CoO/CFP. (b) The Tafel plots of pristine and 2-cycle NiO/CFP. Since the oxidation peak overlaps with the OER onset currents, the Tafel slopes obtained may be influenced by bubble-releasing which gives out overestimated values. (c) The Tafel plots of $Fe_3O_4$/CFP. (d) The Tafel plots of pristine and 2-cycle $Ni_3FeO_x$/CFP and Ir/C benchmark. (e), (f) Stability testing of 2-cycle $Ni_3FeO_x$/CFP under constant current operation for over 12 hours.
Figure 23:
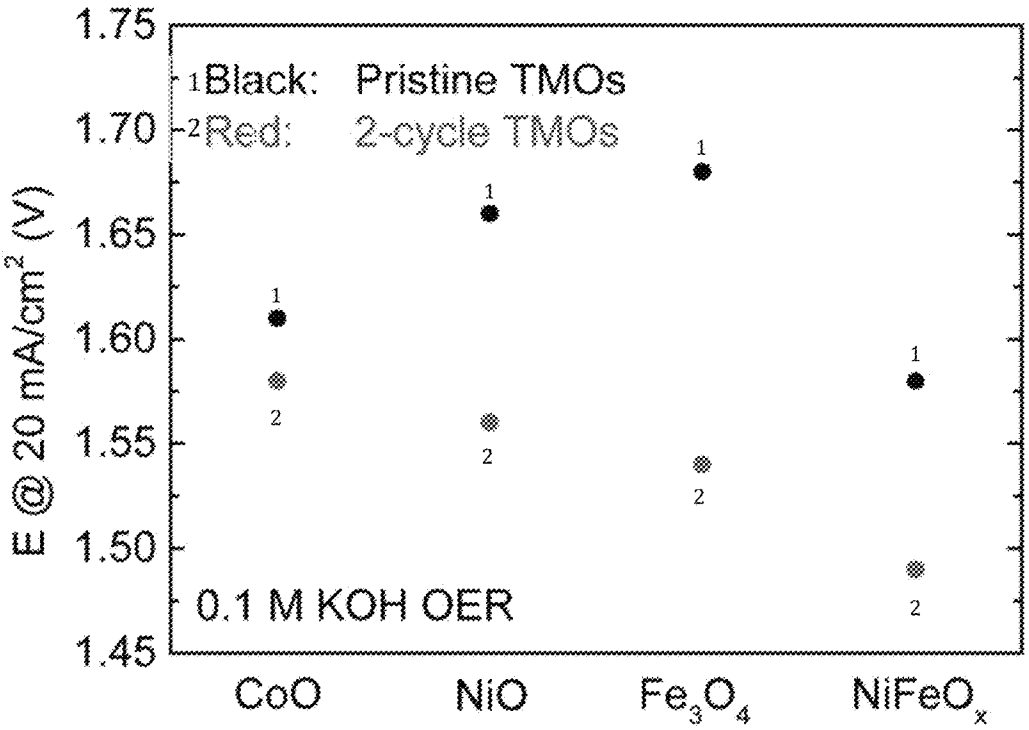
FIG. 23 shows overpotentials of pristine and 2-cycle TMO/CFP catalysts to achieve about 20 mA/cm$^2$ OER current. The improvements are significant after the galvanostatic cycling processes.
Figure 24:
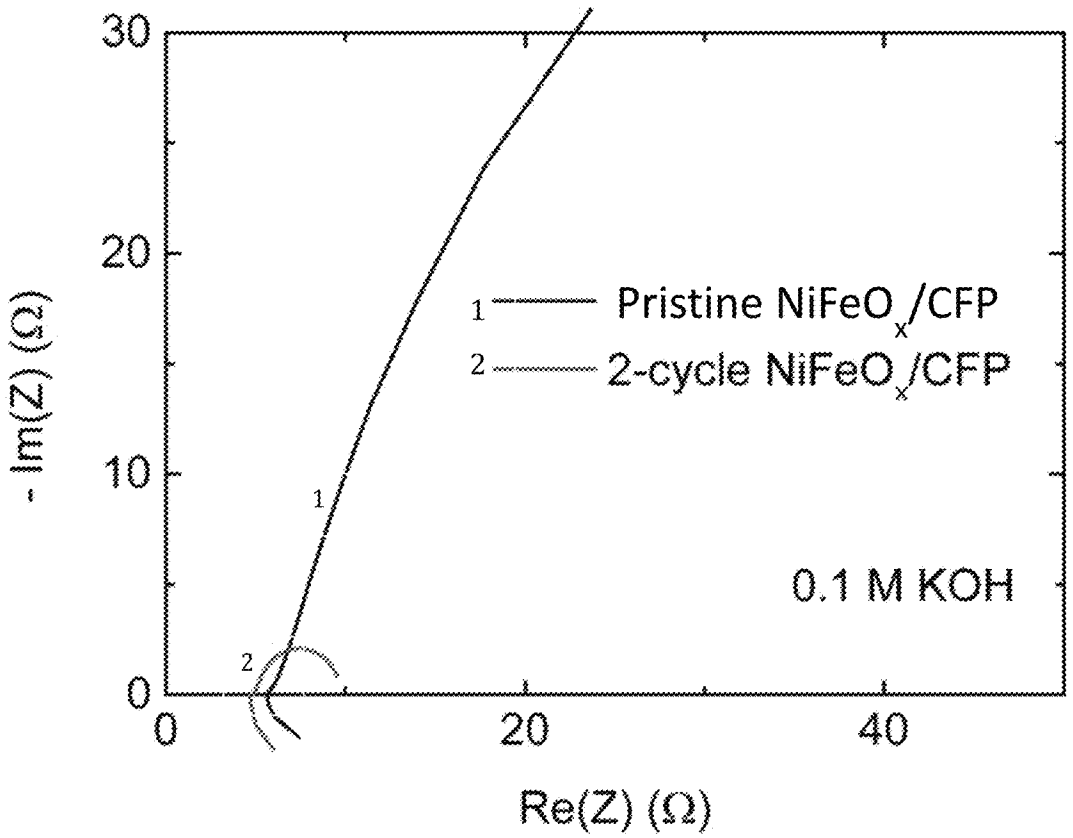
FIG. 24 shows impedance spectra of pristine and 2-cycle $Ni_3FeO_x$/CFP at about 1.5 V vs RHE. The charge transfer impedance is significantly reduced after the galvanostatic cycling process.
Figure 25:
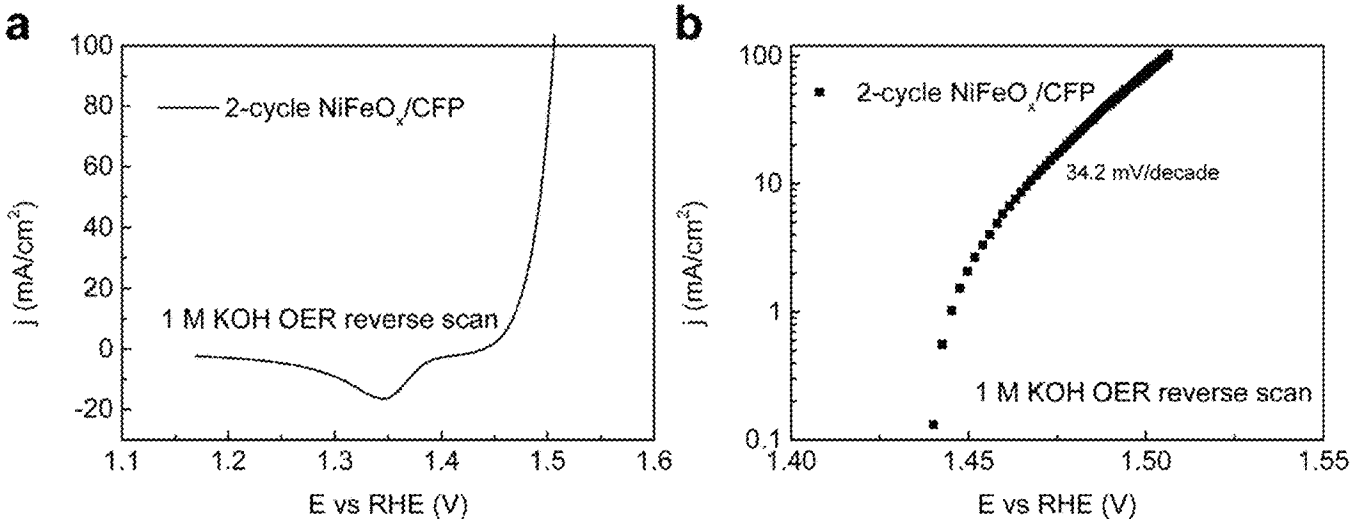
FIG. 25 shows linear sweep voltammogram of 2-cycle $Ni_3FeO_x$/CFP scanning from positive to negative potentials (reverse scan). (a) OER polarization of 2-cycle $Ni_3FeO_x$/CFP by reverse scanning. (b) The corresponding Tafel plots of the reverse scanning OER polarization. The Tafel slope obtained from the reverse scanning is about 34.2 mV/decade, very close to what was previously obtained by the forward scanning in FIG. 3F.
Figure 26:
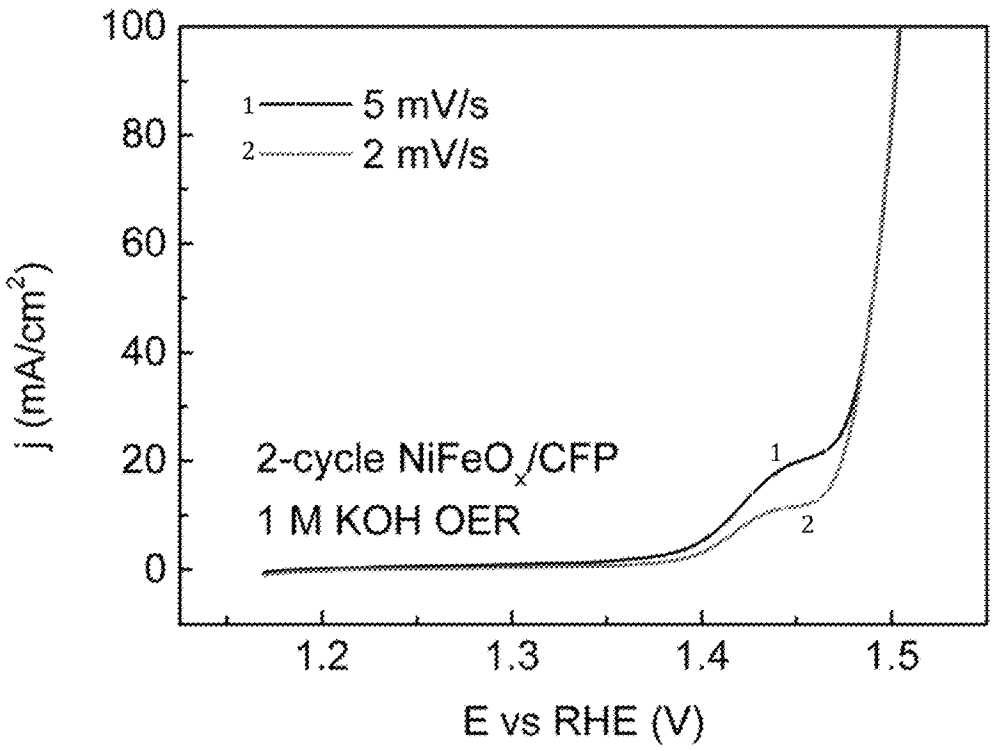
FIG. 26 shows OER polarizations of 2-cycle $Ni_3FeO_x$/CFP under different scanning rates. The two polarization curves closely overlap within the OER range, indicating that both rates are slow enough to reach the steady state for Tafel analysis. Note that a higher scanning rate will result in a larger redox peak of catalyst particles which is reflected in the larger peak of about 5 mV/s below.
Figure 27:
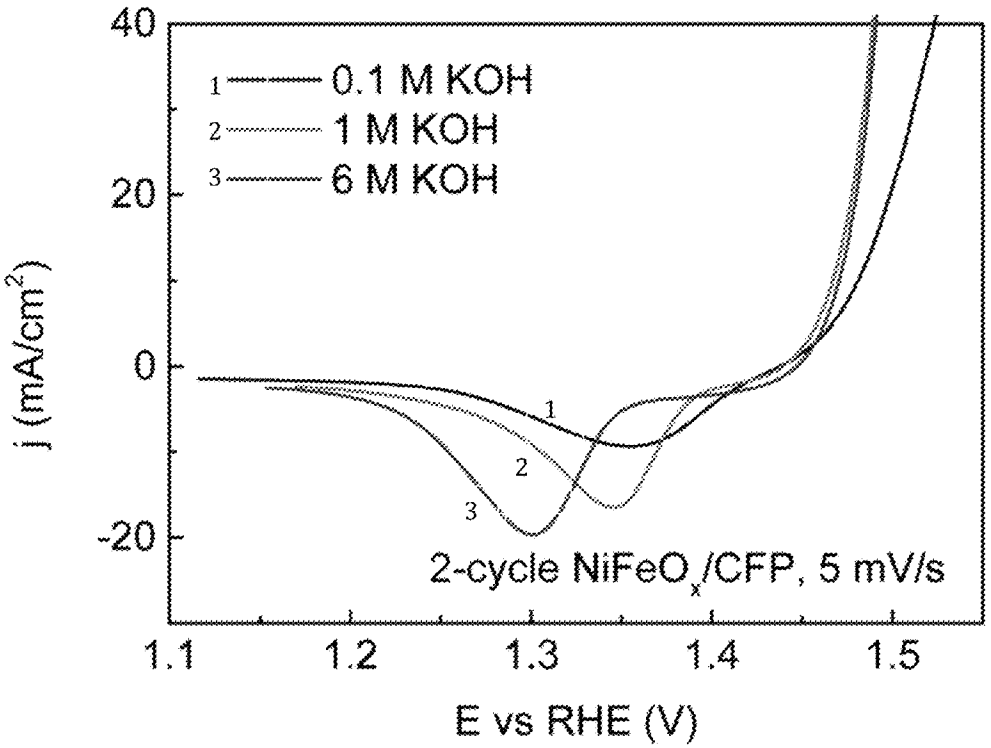
FIG. 27 shows OER polarizations of 2-cycle $Ni_3FeO_x$/CFP in about 0.1 M, about 1 M, and about 6 M KOH by reverse scanning. The areas of the reduction peaks should be equal to the oxidation peaks since this redox is reversible. In about 1 M KOH, the peak area is significantly larger than that in about 0.1 M KOH, indicating a deeper oxidation depth on the catalyst. In about 6 M KOH, the peak position is shifted from about 1 M, and the area is again increased. It is indicating that, in more concentrated KOH, the oxidation process can go deeper on the surface of the $Ni_3FeO_x$ catalyst.
Figure 28:
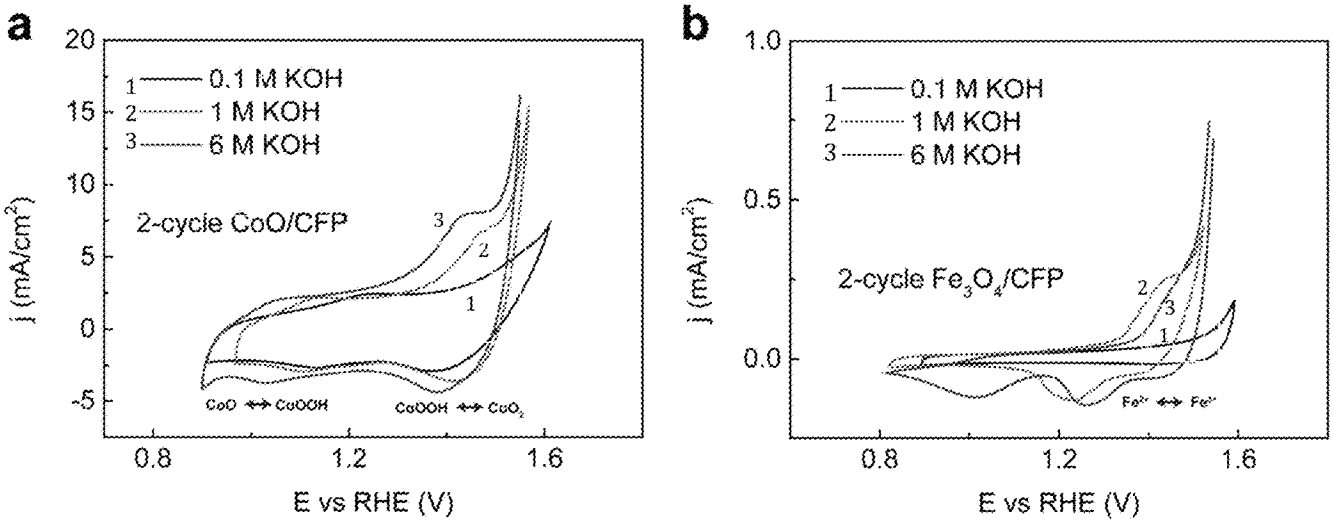
FIG. 28 shows cyclic voltammograms (CVs) of (a) 2-cycle CoO/CFP and (b) $Fe_3O_4$/CFP at a slow scan rate of about 5 mV/s in different concentrated KOH solutions. Different oxidation peaks are observed and assigned.

To avoid the long-term stability and large current bubble-releasing issues of TMO nanoparticles on CNF (due to the use of binder and the hydrophobic nature of carbon respectively), TMO catalysts were directly synthesized on CFP substrates including CoO/CFP, NiO/CFP, $Fe_3O_4$/CFP, and the mixed oxide of $Ni_3FeO_x$/CFP (FIGS. 17-20). The mass loadings of the catalysts are about 1.6 mg/cm$^2$ and the Ir and Pt benchmarks are about 0.5 mg/cm$^2$ (FIG. 21). Galvanostatic cycling shows its general efficacy in improving all of the TMOs from their pristine counterparts, with significantly reduced onset potentials as well as overpotentials to achieve about 20 mA/cm$^2$ OER current (FIGS. 3A-3D; FIGS. 22-24). It is interesting to note that 2-cycle NiO/CFP shows a significantly increased NiO to NiOOH oxidation peak, again confirming the impressively increased surface areas and active sites, which indicates suitable applications of the galvanostatic cycling method in supercapacitors. The best OER performance comes from 2-cycle $Ni_3FeO_x$/CNF (FIGS. 3D and 22). In about 0.1 M KOH, about 20 wt % Ir/C reaches about 10 mA/cm$^2$ and about 20 mA/cm$^2$ at about 1.53 V and about 1.58 V respectively (FIG. 3D). As a comparison, the OER activity of 2-cycle $Ni_3FeO_x$/CFP outperforms this noble metal, with about 1.48 V ($\eta_{OER\ 10\ mA}$=250 mV) and about 1.50 V ($\eta_{OER\ 20\ mA}$=270 mV) to achieve the corresponding currents (FIG. 3D). This highly efficient catalyst exhibits even better OER performance as pH increases to about 14 (about 1 M KOH) (FIG. 3E). To avoid the overlap of the NiO to NiOOH oxidation peak with the OER onset currents, the voltage was scanned from the positive to the negative direction (the inset of FIG. 3E) and determine the onset potential of 2-cycle $Ni_3FeO_x$/CFP in about 1 M KOH to be about 1.43 V ($\eta_{OER\ onset}$=200 mV), nearly about 40 mV lower than Ir/C. The OER current of 2-cycle $Ni_3FeO_x$/CFP then ramps up quickly to about 200 mA/cm$^2$ at about 1.51 V (FIG. 3E). This high OER activity benefits from the small Tafel slope of about 31.5 mV/decade which does not show the curve bending as observed in pristine $Ni_3FeO_x$/CFP and Ir/C, indicating the improved kinetic and bubble-releasing processes by galvanostatic cycling (FIG. 3F). To avoid the oxidation peak and therefore obtain a larger range of current for $Ni_3FeO_x$/CFP Tafel slope analysis, the I-V curve were reversely swept as shown in FIG. 25, and the Tafel slope is calculated to be about 34.2 mV/decade, very close to the forward sweeping result. It is worth noting that the voltage sweeping rate in all of the tests is about 5 mV/s, which is slow enough to reach the steady state for accurate analysis of Tafel slopes (FIG. 26). The reverse scanning method also helps to reveal an interesting conclusion that in more concentrated KOH solution the oxidation process can go deeper on the surface of the $Ni_3FeO_x$ catalyst (FIG. 27). Very small oxidation peaks of CoO and $Fe_3O_4$ were also observed in FIG. 28. Stability of the battery cycled TMO is of concern as to whether these ultra-small interconnected nanoparticles can tolerate the violent condition of gas evolution. An impressive OER stability of 2-cycle $Ni_3FeO_x$/CFP is shown in FIG. 3G, with about 10 mA/cm$^2$ anodic current at about 1.46 V ($\eta_{OER\ 10\ mA}$=230 mV) for over 100 hours without degradation. The high activity and long-term stability confirm the strong interactions between those ultra-small, interconnected nanoparticles, outperforms other OER catalysts, and consequently makes this material attractive for practical applications.

Figure 4:
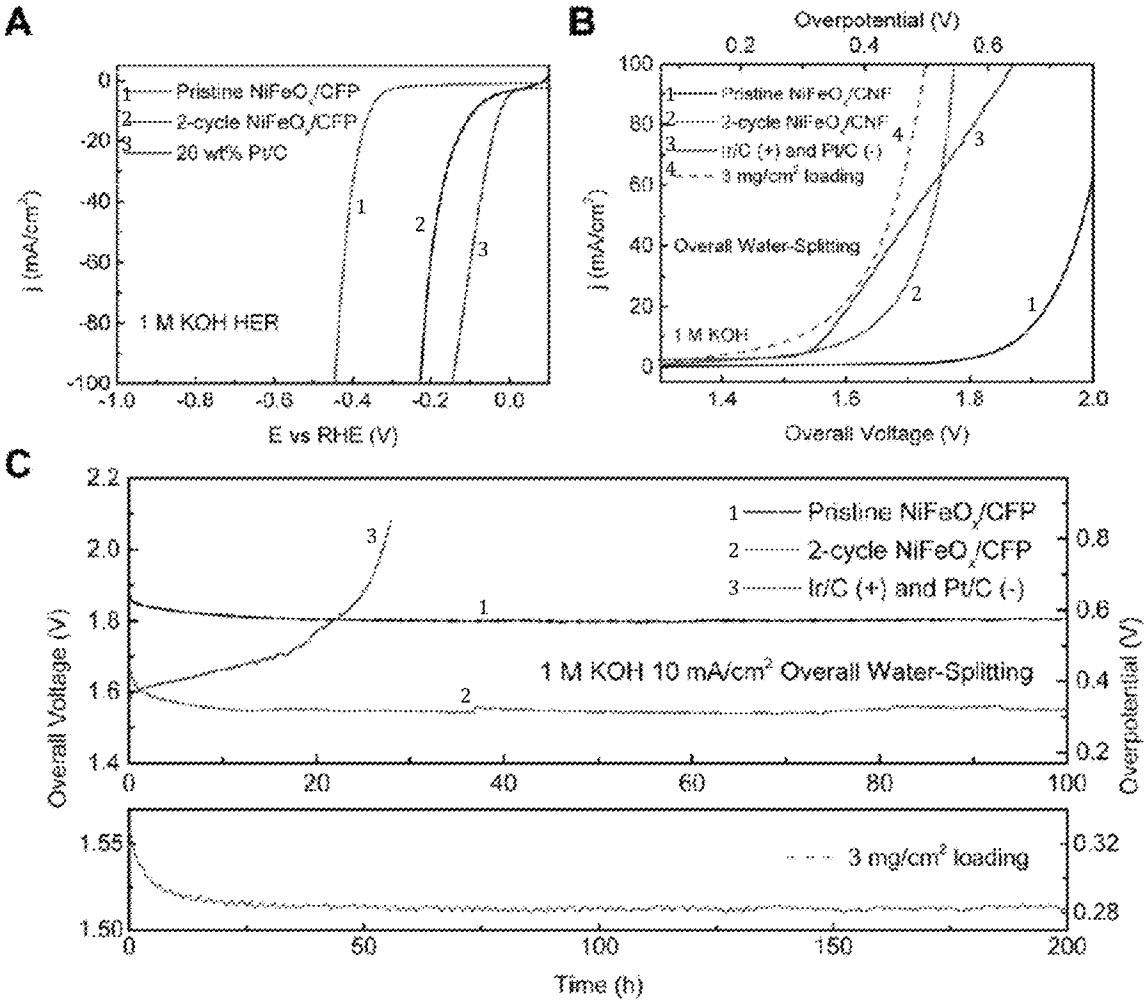
FIG. 4 shows 2-cycle $Ni_3FeO_x$/CFP as a bifunctional catalyst for efficient and stable overall water-splitting. (A) The HER activity of 2-cycle $Ni_3FeO_x$/CFP is significantly improved from its pristine counterpart and close to the Pt/C benchmark. (B) 2-cycle $Ni_3FeO_x$/CFP as an HER and OER bifunctional catalyst in about 1 M KOH for overall water-splitting. Ir/C and Pt/C as OER and HER benchmarks are tested side by side. With the mass loading increased from about 1.6 mg/cm$^2$ to about 3 mg/cm$^2$ (the dash line), the water-splitting activity of 2-cycle $Ni_3FeO_x$/CFP outperforms the benchmark combination. (C) Long-term stability of 2-cycle $Ni_3FeO_x$/CFP bifunctional catalyst. The voltage to achieve about 10 mA/cm$^2$ electrolysis current shows an activation process, stabilized at about 1.55 V for over 100-hour continuous operation. As a sharp contrast, Ir and Pt combination shows an efficient starting voltage but followed by a fast decay. By increasing the mass loading to about 3 mg/cm$^2$, 2-cycle $Ni_3FeO_x$/CFP further lowers the voltage to about 1.51 V to achieve about 10 mA/cm$^2$ current for over 200 hours without decay.
Figure 29:
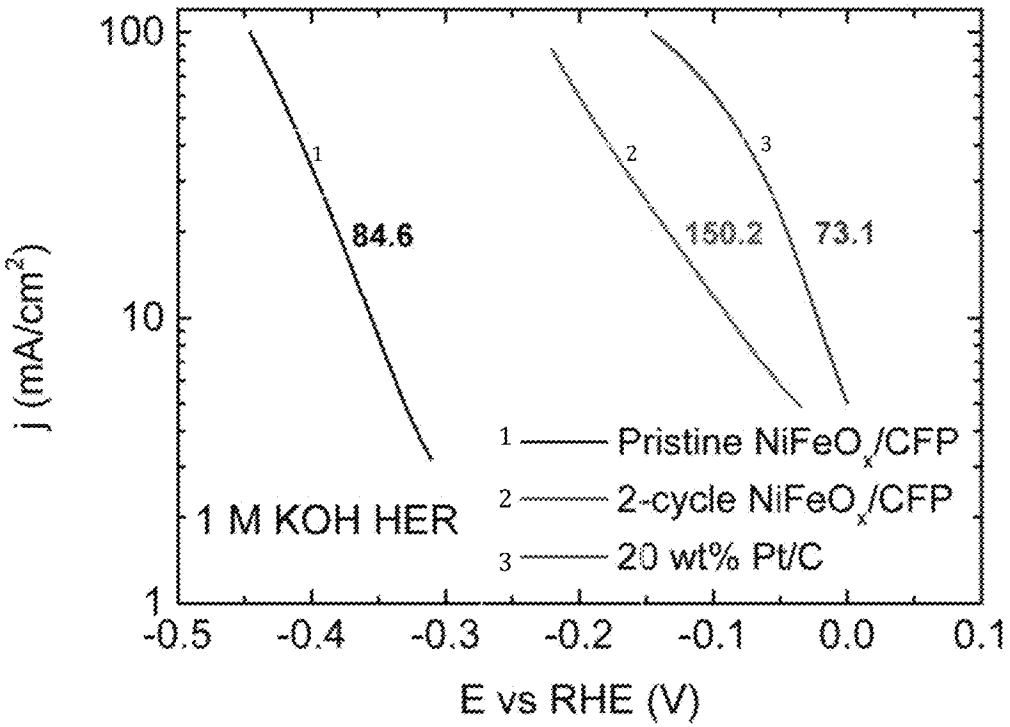
FIG. 29 shows Tafel plots of pristine, 2-cycle $Ni_3FeO_x$/CFP, and Pt/C benchmark for HER.
Figure 30:
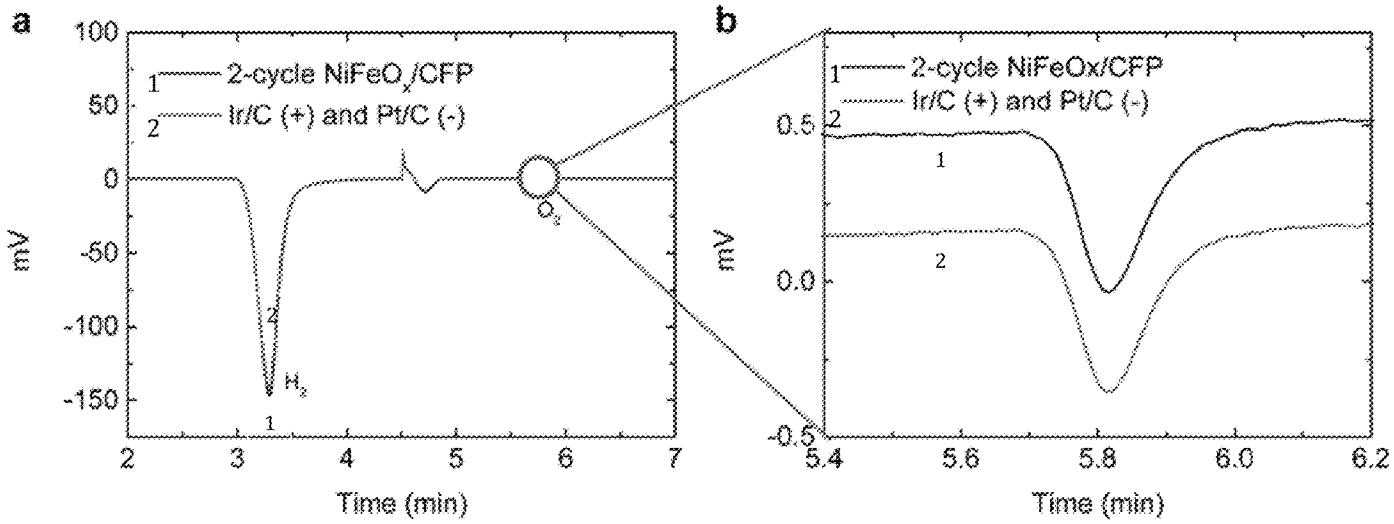
FIG. 30 shows gas chromatography measurements of $H_2$ and $O_2$ produced by 2-cycle $Ni_3FeO_x$/CFP bifunctional catalyst and Ir and Pt benchmark combination. The catalysts were first operated under about 50 mA/cm$^2$ constant current for over 2 hours with Ar flow (about 5 sccm) as the carrier gas to saturate the whole testing system. The sampling process was taken after that. The $H_2$ and $O_2$ peaks have almost the same area between 2-cycle $Ni_3FeO_x$/CFP and benchmark combination, indicating the high faradic efficiencies of both $H_2$ and $O_2$ produced by 2-cycle $Ni_3FeO_x$/CFP. In addition, standard gases with different $H_2$ concentrations were used to calibrate the $H_2$ production efficiency. The calculated Faradaic efficiency (FE) of $H_2$ is about 97%.
Figure 31:
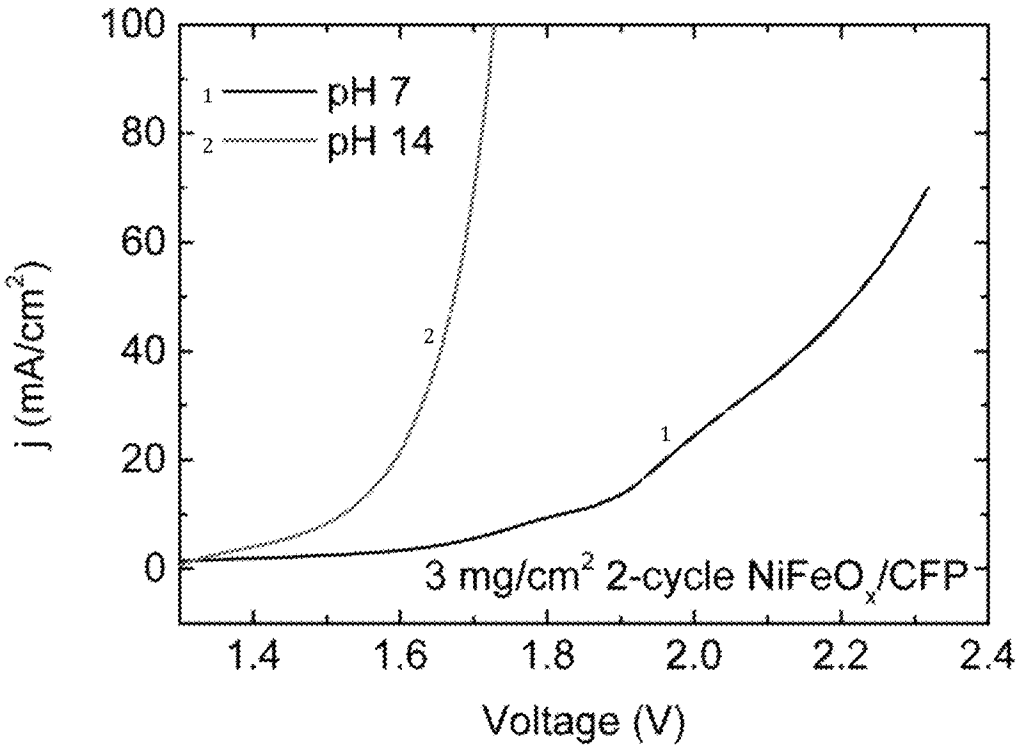
FIG. 31 shows OER polarizations of 2-cycle $Ni_3FeO_x$/CFP in different pH solutions. The pH 7 buffer is 1 M $K_2HPO_4/KH_2PO_4$. The water-splitting activity in alkaline solution is much better than that in neutral.

Efficient HER catalysts in alkaline solutions such as transition metals and their alloys have been investigated, but the HER activities of TMOs are rarely developed, which could impact the use of high-performance bifunctional OER and HER catalysts for overall water-splitting. The HER activity of 2-cycle $Ni_3FeO_x$/CFP as an efficient OER catalyst is also tested in about 1 M KOH, which shows a small onset potential of about −40 mV, significantly improved from its pristine counterpart with a large onset of about −310 mV (FIG. 4A). The Tafel slope increases from about 84.6 mV/decade to about 150 mV/decade after the battery cycling process, which may be related to a change of the reaction pathway or a mass transport limit (FIG. 29). A small overpotential of about −88 mV is involved for 2-cycle $Ni_3FeO_x$/CFP to reach about −10 mA/cm$^2$ cathodic current, which is not far from the Pt benchmark of about −23 mV (FIG. 4A). Together with the other half reaction of OER, the galvanostatic cycling method creates an attractive bifunctional $Ni_3FeO_x$/CFP water-splitting catalyst to compete with the combination of Pt and Ir benchmarks. The overall water-splitting polarization of 2-cycle $Ni_3FeO_x$/CFP bifunctional catalyst exhibits a slightly larger onset voltage than the benchmark combination, but quickly catches up due to the facile kinetic and bubble-releasing processes (FIG. 4B). In addition, the sizes of $O_2$ and $H_2$ bubbles observed on 2-cycle $Ni_3FeO_x$/CFP electrodes under about 200 mA/cm$^2$ are distinctively smaller than those on the benchmark electrodes, indicating the great capability for large current operations. The long-term stability testing further illustrates the advantages of 2-cycle $Ni_3FeO_x$/CFP over those noble metals (FIG. 4C). With a slightly higher starting voltage to achieve about 10 mA/cm$^2$ of constant water-splitting current, 2-cycle $Ni_3FeO_x$/CFP exhibits a gradually increased catalytic activity and surpasses the benchmark combination after 1-hour operation (FIG. 4C). Gas chromatography measurements of 2-cycle $Ni_3FeO_x$/CFP water electrolysis confirm a high faradic efficiency of $O_2$ and $H_2$, calibrated by the benchmark electrodes (FIG. 30). During the long-term stability testing it is possible for the oxidation process (MO to MOOH) to get deeper at a very slow rate, gradually reaching to a limit. This may help to create additional active sites and refresh the boundaries of the interconnected particles, which slightly increases the activity. The gas evolution may help to remove surface residues from the battery cycling, or gradually fresh the boundaries closely blocked by interconnected nanoparticles before, which contribute to the activation process observed. The voltage stabilizes at about 1.55 V ($\eta_{overall\ 10\ mA}$=320 mV) for over 100-hour continuous operation, in a sharp contrast to the benchmark combination (FIG. 4C). In addition, the water-splitting performance of the catalyst can be further improved by increasing the mass loading to about 3 mg/cm$^2$ (FIGS. 4B and 4C). The high-mass catalyst further brings the voltage down to about 1.51 V ($\eta_{overall\ 10\ mA}$=280 mV) to achieve about 10 mA/cm$^2$ current, with remarkable stability of over 200 hours with no noticeable sign of decay (FIG. 4C). Overall water-splitting in neutral electrolyte is also tested in FIG. 31, which shows slower activity compared with that in the alkaline solution.

By improving both OER and HER activities, the galvanostatic cycling method successfully elevates the efficiency of water-splitting electrolyzer at about 10 mA/cm$^2$ current to about 81.5%, facilitating the scale-up of water photolysis/electrolysis with high-efficiency and low-cost. In addition, the increased OER and HER activities can promote the use of the galvanostatic cycling method in other important applications of TMOs or TMCs.

Figure 32:
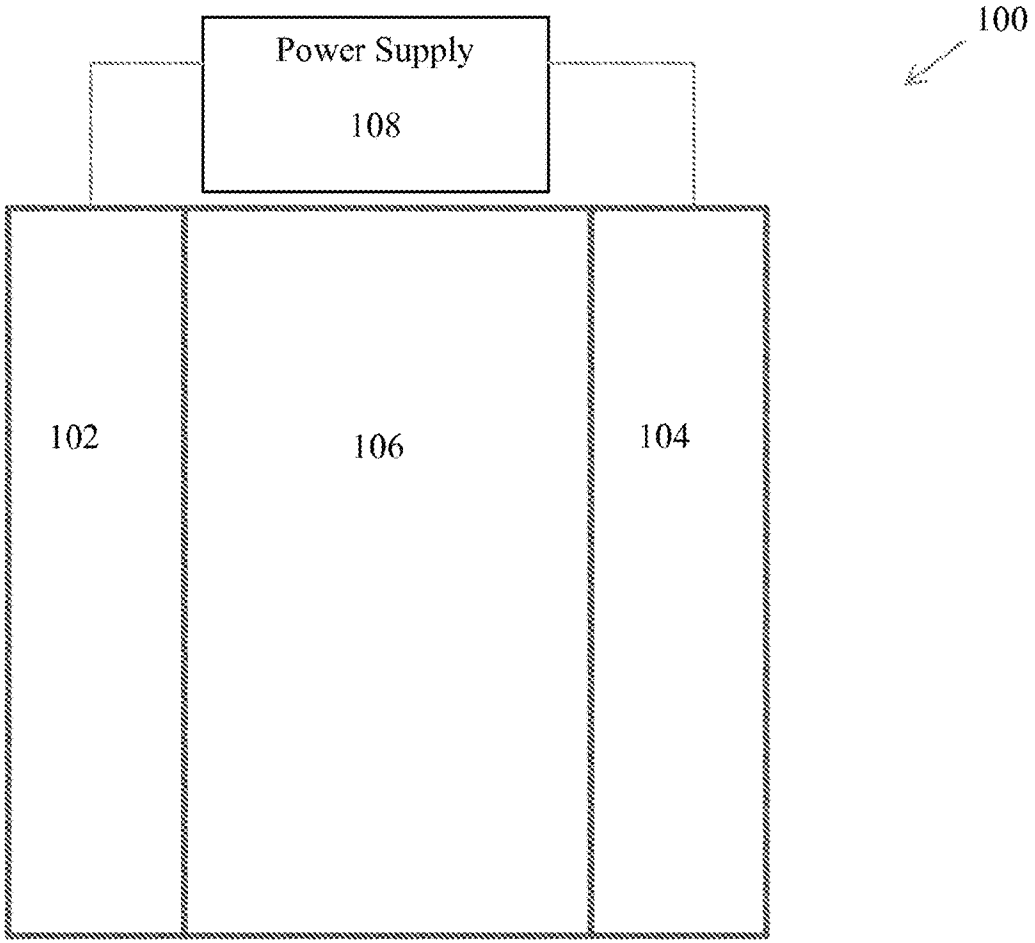
FIG. 32 shows a schematic of a water-splitting device (a water electrolyzer) including the electrocatalysts disclosed herein.

As shown in an embodiment of FIG. 32, a water-splitting device (electrolyzer 100) includes an anode 102, a cathode 104, and an electrolyte 106 disposed between and in contact with the anode 102 and the cathode 104. The anode 102 is configured to promote water oxidation or OER and includes an OER electrocatalyst affixed to a substrate. The cathode 104 is configured to promote water reduction or HER and includes a HER electrocatalyst affixed to a substrate. Examples of suitable catalysts include TMOs/TMCs nanoparticle catalysts disclosed herein. In some implementations, the anode 102 and the cathode 104 include the same electrocatalyst. The electrolyte 106 is an aqueous electrolyte and can be alkaline, acidic, or neutral. As shown in FIG. 32, the electrolyzer 100 also includes a power supply 108, which is electrically connected to the anode 102 and the cathode 104 and is configured to supply electricity to promote OER and HER at the anode 102 and the cathode 104, respectively. The power supply 108 can include, for example, a primary or secondary battery or a solar cell. Although not shown in FIG. 32, a selectively permeable membrane or other partitioning component can be included to partition the anode 102 and the cathode 104 into respective compartments.

Working Examples and Apparatus

Cnf Synthesis.

About 0.5 g polyacrylonitrile (PAN, Mw=150,000, Sigma-Aldrich) and about 0.5 g polypyrrolidone (PVP, Mw=1,300,000, Sigma-Aldrich) were dissolved in about 10 ml of dimethylformamide (DMF) under about 80° C. with constant stirring. The solution was electrospun using an electrospinning set-up with the following parameters: about 15 kV of static electric voltage, about 18 cm of air gap distance, about 3 ml PVP and PAN solution, and about 0.5 ml/h flow rate. A CFP substrate (about 8 cm×8 cm) was used as the collection substrate. The electronspun polymer nanofibers on the CFP was then heated up to about 280° C. for about 30 min in the box furnace, and kept under the temperature for about 1.5 hours to oxidize the polymers. After the oxidization process, the nanofibers were self-detached from the carbon paper resulting in the freestanding film. Those nanofibers were carbonized under argon atmosphere at about 900° C. for about 2 hours to become a CNF matrix.

Coo/Cnf Synthesis.

The solution of cobalt nitrate was first prepared by dissolving about 25 wt % $Co(NO_3)_2.6H_2O$ (Sigma-Aldrich) and about 1 wt % PVP (Mw=360,000, Sigma-Aldrich) into about 56 wt % deionized water. Specifically, about 1.25 g of $Co(NO_3)_2.6H_2O$ and about 0.05 g of PVP were dissolved into about 3.7 ml of deionized water. $O_2$ plasma treated CNF matrix was then dipped into the solution and dried in the vacuum for overnight. The $Co(NO_3)_2$/CNF was then heated up to about 500° C. for about 1 hour under about 1 atm Ar atmosphere with a slow flow rate of about 10 sccm in a tube furnace and kept there for about 1.5 hours, where the $Co(NO_3)_2$ was decomposed into CoO nanoparticles. The mass ratio of CoO to CNF is about 0.24.

Tmo/Cfp Synthesis.

TMO nanoparticles were directly synthesized on CFP electrode (AvCarb MGL190, FuelCellStore) by the same dip-coating method mentioned above. Specifically, about 4 g of transition metal nitrite (40 wt %) and about 0.4 g of PVP (4 wt %) were dissolved into about 5.6 ml deionized water. The mixture of $Ni(NO_3)_2.6H_2O$ and $Fe(NO_3)_3.9H_2O$ was based on the molar ratio of about 3:1. The thermal decomposition process is the same with CoO/CNF synthesis. The high temperature during the synthesis helps to create strong bonds between the catalysts and substrates, which can greatly benefit their stabilities. The mass loading of the TMOs on CFP is about 1.6 mg/cm$^2$. Large mass loading of about 3 mg/cm$^2$ is obtained by using the CFP substrate with larger surface areas (AvCarb MGL370, FuelCellStore).

OER Electrode Preparation.

CoO/CNF was first put into a stainless steel vial for about 20 min ball milling (5100 Mixer/Mill, SPEX SamplePrep LLC). These small pieces with nafion (Nafion 117 solution, Sigma-Aldrich) were then dispersed into ethanol with a concentration of about 5 mg/ml. The mass ratio of CoO/CNF to nafion is about 10:1. The solution was then drop onto CFP electrode with a mass loading of about 0.6 mg/cm$^2$ (based on the CoO/CNF). The preparations of Ir/C (about 20 wt % Ir on Vulcan XC-72, Premetek Co.) and Pt/C (about 20 wt % Pt on Vulcan, FuelCellStore) inks are the same with that of CoO/CNF. The mass loading of Ir and Pt on CFP is about 0.5 mg/cm$^2$. Higher loading may result in severe bubble-releasing problems due to the high concentration of carbon (FIG. 21).

Galvanostatic Cycling.

The as-grown CoO on CNF matrix was made into a pouch cell battery with a piece of Li metal and about 1.0 M $LiPF_6$ in about 1:1 w/w ethylene carbonate/diethyl carbonate (EMD Chemicals) as electrolyte. The galvanostatic cycling current was set at about 173 mA/g and cycle between about 0.4 V and about 3 V vs $Li^+$/Li. The cutoff voltage of the last discharging step is about 4.3 V for thorough delithiation. The galvanostatic cycled CoO on CNF matrix was then washed by ethanol for SEM, XRD, and Raman and sonicated into small pieces for TEM characterizations. CoO/CNF on CFP was cycled at about 0.1 mA/cm$^2$ current and TMO/CFP catalysts electrodes were cycled at about 62.5 mA/g current.

Electrochemical Characterizations.

All of the electrochemical tests were performed under about 1 atm in air and room temperature of about 25° C. OER, HER, and ECDLC were tested in a three-electrode set-up and overall water-splitting was performed in a two-electrode system. Saturated calomel electrode (SCE) was selected as the reference electrode with a potential of about 0.99 V vs RHE in about 0.1 M KOH, about 1.049 V vs RHE in about 1 M KOH, and about 1.131 V vs RHE in about 6 M KOH calibrated by purging pure $H_2$ gas on the Pt wire. Pt wire and Ni foam were used as counter electrodes for OER and HER tests respectively. In the two-electrode full cell, one 2-cycle $Ni_3FeO_x$/CFP (or pristine $Ni_3FeO_x$/CFP) electrode was used as the positive electrode for OER and the other 2-cycle $Ni_3FeO_x$/CFP (or pristine $Ni_3FeO_x$/CFP) electrode was used as the negative electrode for HER. For the benchmark control, Ir/C acted as the positive electrode and Pt/C as the negative electrode. The impedance spectra of OER in three-electrode system were tested under about 1.5 V vs RHE in about 0.1 M KOH and about 1.45 V vs RHE in about 1 M KOH with an example of $Ni_3FeO_x$/CFP in FIG. 24. The HER impedance was tested under about −0.05 V vs RHE. The impedance of the two-electrode full cell was tested under about 1.5 V voltage. All of the potentials and voltages are iR-corrected unless noted. The two-electrode full cell stability testing was performed in a 100 ml lab bottle with two electrodes located around 3 to 5 cm away from each other to prevent the crossover of the gas products. The bottle was open to the air during the testing to release the produced $H_2$ and $O_2$. All of the polarization curves were obtained at the scanning rate of about 5 mV/s.

As used herein, the singular terms "a," "an," and "the" include plural referents unless the context clearly dictates otherwise. Thus, for example, reference to a metal can include multiple metals unless the context clearly dictates otherwise.

As used herein, the terms "substantially," "substantial," and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

In the foregoing description, it will be readily apparent to one skilled in the art that varying substitutions and modifications may be made to the invention disclosed herein without departing from the scope and spirit of the invention. The invention illustratively described herein suitably may be practiced in the absence of any element or elements, limitation or limitations, which is not specifically disclosed herein. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scopes of this invention.

What is claimed is:

1. A method for improving a catalytic activity of an electrocatalyst, comprising: synthesizing monocrystalline nanoparticles of the electrocatalyst on a conducting substrate; and subjecting the monocrystalline nanoparticles of the electrocatalyst on the conducting substrate to 1-10 galvanostatic lithiation/delithiation cycles to form polycrystalline nanoparticles of the electrocatalyst, wherein the electrocatalyst comprises at least one transition metal oxide (TMO) or transition metal chalcogenide (TMC), and the conducting substrate is a carbon-based substrate comprising carbon fibers.

2. The method of claim 1, wherein the electrocatalyst is subjected to 1-5 of the galvanostatic lithiation/delithiation cycles.

3. The method of claim 2, wherein the electrocatalyst is subjected to 2 of the galvanostatic lithiation/delithiation cycles.

4. The method of claim 1, wherein the electrocatalyst comprises at least one of Fe, Co, or Ni.

5. The method of claim 1, wherein the electrocatalyst comprises the at least one TMO selected from cobalt oxide, nickel oxide, iron oxide, and mixed oxide of nickel and iron.

6. The method of claim 1, wherein the monocrystalline nanoparticles have at least one lateral dimension of 5-100 nm before the galvano static lithiation/delithiation cycles.

7. The method of claim 1, wherein the monocrystalline nanoparticles have at least one lateral dimension of 10-50 nm before the galvanostatic lithiation/delithiation cycles.

8. The method of claim 1, wherein each of the polycrystalline nanoparticles comprises interconnected crystalline nanoparticles having at least one lateral dimension of 1-10 nm after the galvanostatic lithiation/delithiation cycles.

9. The method of claim 1, wherein each of the polycrystalline nanoparticles comprises interconnected crystalline nanoparticles having at least one lateral dimension of 2-5 nm after the galvanostatic lithiation/delithiation cycles.

10. The method of claim 1, wherein each of the polycrystalline nanoparticles comprises interconnected crystalline nanoparticles after the galvano static lithiation/delithiation cycles.

11. The method of claim 1, wherein the monocrystalline nanoparticles are disposed on the conducting substrate at a mass loading of 1-10 $mg/cm^2$ or 2-5 $mg/cm^2$.

12. The method of claim 1, further comprising incorporating the electrocatalyst in a water splitting device.

13. The method of claim 1, wherein synthesizing the monocrystalline nanoparticles of the electrocatalyst on the conducting substrate comprises coating the conducting substrate with a precursor solution and heating the conducting substrate coated with the precursor solution.

14. The method of claim 1, wherein the conducting substrate is a carbon fiber paper.

* * * * *